US005887564A

United States Patent [19]

Kawamoto

[11] Patent Number: 5,887,564

[45] Date of Patent: Mar. 30, 1999

[54] INTERNAL COMBUSTION ENGINE FOR SMALL PLANING WATERCRAFT

[75] Inventor: Yuichi Kawamoto, Akashi, Japan

[73] Assignee: Kawasaki Jukogyo Kabushiki Kaisha, Hyogo, Japan

[21] Appl. No.: 886,687

[22] Filed: May 30, 1997

[30] Foreign Application Priority Data

May 31, 1996 [JP] Japan ..... 8-137892
Jun. 3, 1996 [JP] Japan ..... 8-139847

[51] Int. Cl.[6] ..... F02P 1/00

[52] U.S. Cl. ..... 123/196 R; 114/270; 440/84

[58] Field of Search ..... 123/196 R, 196 W; 114/270; 440/84, 87

[56] References Cited

U.S. PATENT DOCUMENTS 4,628,878 12/1986 Nakano et al. ..... 123/196 R
4,732,237 3/1988 Nakano ..... 123/196 R

FOREIGN PATENT DOCUMENTS

86/03551 6/1986 European Pat. Off. ..... 123/196 R
779412 12/1996 European Pat. Off. ..... 123/196 R
2524 1/1994 Japan ..... 123/196 R
237586 9/1995 Japan .
237587 9/1995 Japan .
260926 10/1996 Japan ..... 123/196 R

*Primary Examiner*—John Kwon
*Attorney, Agent, or Firm*—Marshall, O'Toole, Cerstein, Murray & Borun

[57] ABSTRACT

A four-cycle engine mounted on a small planing watercraft is disclosed, in which an oil tank is integrally formed with the side walls of a cylinder head, a cylinder block, a crankcase, or an oil pan of the engine body. An oil receptacle is arranged on the bottom of the engine body and communicating with the internal space of the crankcase. The engine body includes an oil passage for transporting the engine oil collected in the oil receptacle to the oil tank by a scavenging pump, and an oil passage for supplying the engine oil in the oil tank to the various parts of the engine body by a feed pump. The oil tank may be formed of a tank base portion integral with the side walls of the engine body and a tank cover. Oil mist separating fin may be arranged in the oil tank.

12 Claims, 22 Drawing Sheets

INTERNAL COMBUSTION ENGINE FOR SMALL PLANING WATERCRAFT

FIELD AND BACKGROUND OF THE INVENTION

The present invention relates to an internal combustion engine mounted on a small planing watercraft, and more particularly to a four-cycle internal combustion engine with a dry sump lubricating system with an improved engine oil tank for a small planing watercraft.

A small planing watercraft for running on a water surface by ejecting water rearward by a water jet pump mounted on a rearward bottom portion of a hull is a watercraft with a high sports utility, and therefore a two-cycle engine small in size and light in weight normally is mounted thereon. A two-cycle engine which accumulates no engine oil in the crank case has the advantage that no engine oil flows into the combustion chamber in case the small planing watercraft turns over. A two-cycle engine, therefore, is suitable for a small planing watercraft.

In recent years, a four-cycle engine with relatively low noise level and clean exhaust gasses has been examined for mounting on a small planing watercraft in view of the need of environmental protection. Attempts have been made to employ a dry sump lubrication system in which no engine oil is accumulated in the crank case, for preventing the engine oil from flowing into the combustion chamber from the crankcase even when the small planing watercraft turns over.

A small planing watercraft having mounted thereon a four-cycle internal combustion engine with a dry sump lubrication system is disclosed in JP-A-7-237586 and JP-A-7-237587. In a small watercraft disclosed in the former publication, an engine oil tank is arranged under an air suction device and communicates through an oil pump with an oil pan arranged under the engine. In a small watercraft of the latter publication, on the other hand, an oil tank for engine lubrication is arranged above a coupling between an engine output shaft extending in the longitudinal direction of the watercraft and an impeller shaft, and communicates through the oil pump with the oil pan arranged under the engine.

In all the above-mentioned engines, however, the oil tank is separately mounted from the engine body, and therefore a space and parts are required for mounting the oil tank. Also, external pipings are required for transporting the oil from the crankcase to the oil tank by means of a scavenging pump, and for supplying the oil from the oil tank to various parts of the engine by means of a feed pump. Consequently, the mounting space and the weight of the engine including the oil tank are increased. Further, the external pipings are complicated and increase the mechanical loss due to the flow resistance in the pipings, leading to the problem of a delayed response to an oil pressure increase. Furthermore, in the case where the oil tank is arranged to communicate with a suction device of the engine to send a blow-by gas in the oil tank through a breather pipe to the air suction device, the engine oil in the oil tank tends to flow out through the breather pipe when the small planing watercraft turns over.

The present invention has been developed in view of the above-mentioned problems which have been posed when a four-cycle engine with a dry sump lubrication system is mounted on a small planing watercraft.

Accordingly, an object of the invention is to provide a compact, lightweight, and rigidity increased four-cycle engine with dry sump lubrication system mounted on a small planing watercraft.

Another object of the invention is to provide a four cycle engine with a dry sump lubrication system for a small planing watercraft, in which the mechanical loss due to the flow resistance in the piping is reduced for an improved oil-pressure rise response, and the mounting space of the engine is reduced by simplifying the oil piping system.

Still another object of the invention is to provide a four cycle engine with a dry sump lubrication system for a small planing watercraft, in which the engine oil is prevented from flowing into a combustion chamber while at the same time preventing the engine oil from flowing out of an oil tank when the small planing watercraft turns over.

A further object of the invention is to provide a four cycle engine with a dry sump lubrication system for a small planing watercraft, in which the separability of the engine oil from the blow-by gas in the oil tank is improved and the oil is prevented from flowing out of a breather passage along with the blow-by gas.

SUMMARY OF THE INVENTION

The above-described objects are achieved by the present invention. Specifically, according to one aspect of the present invention, there is provided a four-cycle internal combustion engine with a dry sump lubrication system for a small planing watercraft, comprising an oil receptacle located at a bottom of an engine body and communicating with an internal space of a crankcase, an oil tank formed by utilizing a wall of the engine body, an oil passage for transporting the oil collected in the oil receptacle to the oil tank by means of a scavenging pump, and an oil passage for supplying the engine oil in the oil tank to various parts in the engine body by means of a feed pump.

With this configuration, a part of the wall of the oil tank is formed with any one of the walls of the engine body (a housing of the internal combustion engine including a cylinder head, a cylinder block, a crankcase and an oil pan), and therefore the oil tank is integrated with the engine body. As a result, the weight and the mounting space are reduced as compared with the prior described engine with a separately mounted oil tank. Also, since the oil tank is integrated with the engine body, the rigidity of the engine body is increased, and further, since the oil passage is shortened, pressure loss of the engine oil due to the piping resistance is reduced to improve the oil-pressure rise response.

According to a second aspect of the invention, there is provided an internal combustion engine for the small planing watercraft, in which the oil tank is formed on a side wall of a crankcase and on a side wall of a cylinder block as viewed in the direction of the axis of a crankshaft to secure a large capacity of the oil tank having a large vertical size and a large interior space above the oil level, thereby promoting the separation of the oil in the blow-by gas introduced in the oil tank from the crankcase.

According to a third aspect of the invention, there is provided an internal combustion engine for the small planing watercraft, in which the oil tank and the crankcase are formed with divided portions which are divided by substantially horizontal planes and joined with each other. Therefore, the oil tank is easily fabricated.

According to a fourth aspect of the invention, there is provided an internal combustion engine for the small planing watercraft, in which the oil tank includes a tank base portion integrally formed with walls of the engine body and a tank cover mounted on the tank base portion. With this configuration, the inner surface of the oil tank interior can be visually checked before the tank cover is mounted, and a separately provided tank cover facilitates forming irregular configurations on the inner surface of the oil tank.

According to a fifth aspect of the invention, there is provided an internal combustion engine for a small planing watercraft, in which the tank base portion is formed on the side wall of the crankcase and on the side wall of the cylinder block as viewed in the direction of the axis of the crankshaft. Therefore, a large-capacity oil tank having a large vertical size can be formed simply by mounting a tank cover.

According to a sixth aspect of the invention, there is provided an internal combustion engine for a small planing watercraft, in which the tank base portion and the crankcase are formed with divided portions which are divided by substantially horizontal planes and joined with each other. Therefore, the tank base portion is easily fabricated.

According to a seventh aspect of the invention, there is provided an internal combustion engine for a small planing watercraft, in which the oil tank is formed on a side wall of a cylinder head and on a side wall of a cylinder block at the longitudinal end side of the crankshaft. Therefore, the dead space above the generator case or the coupling case can be effectively utilized, thereby making it possible to form a large-capacity oil tank.

According to an eighth aspect of the invention, there is provided an internal combustion engine for a small planing watercraft, in which the oil tank further includes an oil mist separating fin arranged on the inner surface. Therefore, the oil in the blow-by gas introduced with engine oil from the crankshaft is separated and recovered in the form of oil drips thereby to reduce the engine oil consumption and to prevent contamination of the breather passage by the engine oil. Also, the fins immersed in the oil stabilizes the oil level and prevents the air from being sucked into the feed pump, thereby making it possible to always supply a proper amount of oil to the various parts of the engine.

According to a ninth aspect of the invention, there is provided an internal combustion engine for the small planing watercraft, in which the scavenging pump and the feed pump are arranged in the engine body, and oil passages connecting these pumps and the oil tank are also formed in the engine body. Therefore, the internal combustion engine can be reduced in weight and mounting space compared to the engine with a separately mounted oil tank and with external oil piping, and further simplifying the assembly work.

According to a tenth aspect of the invention, there is provided an internal combustion engine for the small planing watercraft, in which the upper part of the oil tank is communicated with the air suction device of the engine by a breather passage arranged by way of the height in the neighborhood of the bottom of the oil tank, so that in the case where the small planing watercraft turns over with the tank upside down, the breather pipe portion in the neighborhood of the tank bottom rises above the oil level. Therefore, the engine oil in the oil tank is prevented form flowing out through the breather pipe.

According to an eleventh aspect of the invention, there is provided an internal combustion engine for a small planing watercraft, in which a valve is arranged in a breather passage communicating the upper part of the oil tank and the air suction device of the engine to close the passage when the small planing watercraft turns over. Therefore, the engine oil in the oil tank is prevented from flowing out through the breather passage when the watercraft turns over, by further simplifying the breather passage.

According to a twelfth aspect of the invention, there is provided an internal combustion engine for a small planing watercraft, further comprising a turn-over detection switch for automatically stopping the engine when the small planing watercraft turns over. When the engine stops the feed pump is also stopped, therefore the engine oil in the oil tank is prevented from flowing into the combustion chamber and the spark plug is prevented from being contaminated with the engine oil, thereby facilitating the restarting of the engine.

BRIEF DESCRIPTION OF THE DRAWINGS

FIG. 22 shows a turn-over switch and other devices of a small planing watercraft, in which

DETAILED DESCRIPTION OF THE PREFERRED EMBODIMENTS

Figure 1:
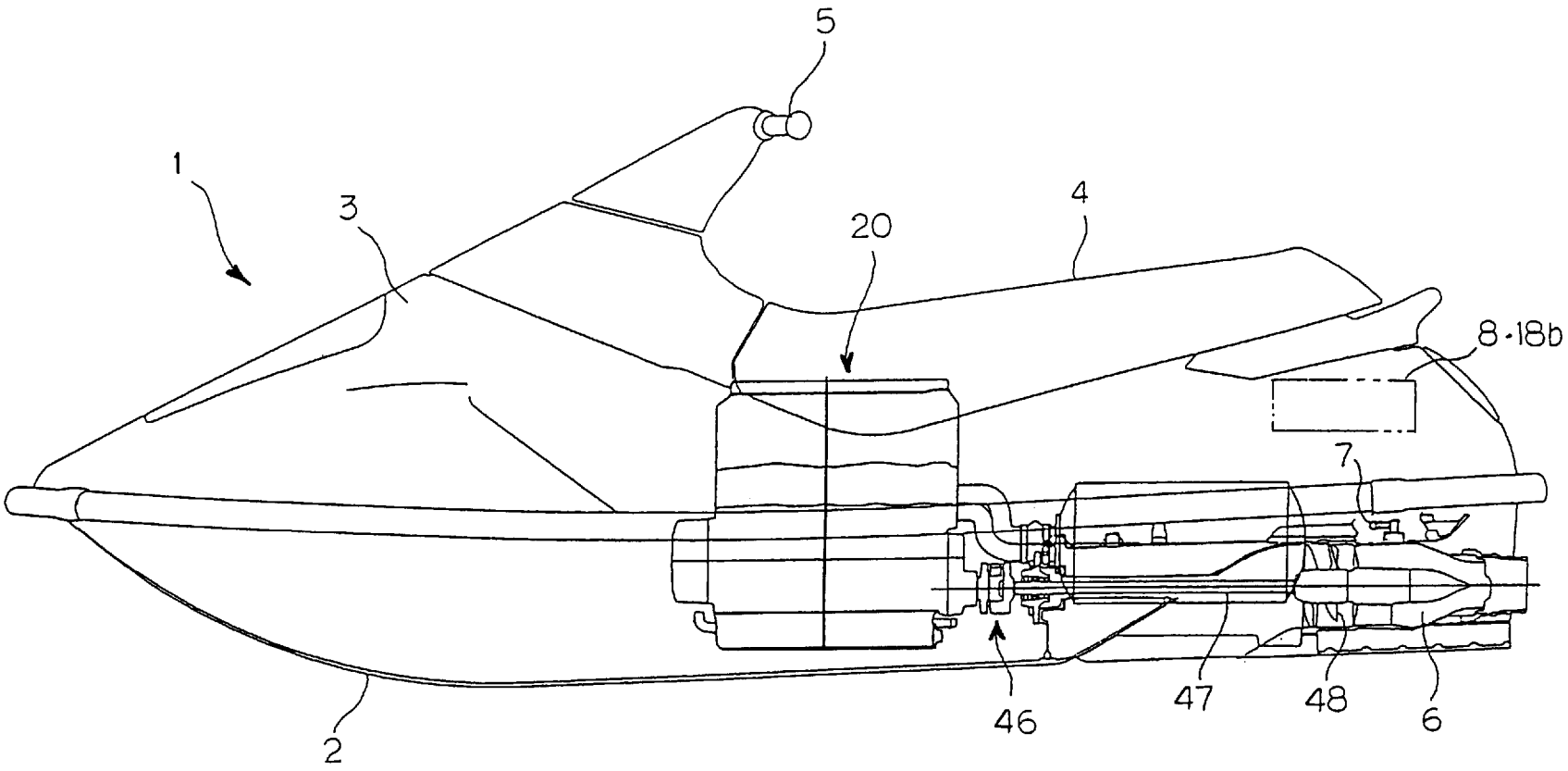
FIG. 1 is a partially perspective side view of a small planing watercraft having mounted thereon an internal combustion engine according to the present invention.

An internal combustion engine for a small planing watercraft according to the present invention will be explained in detail below with reference to the accompanying drawings.

First, a small planing watercraft 1 will be described with reference to FIG. 1. The small planing watercraft 1 is a watercraft adapted to plane on the water surface near the sea coast or lake coast. The watercraft comprises a hull 2, and a deck 3, a seat 4 and steering bars 5 mounted on the hull 2, and one or several persons can go on board. An engine 20 is mounted at substantially the central portion of the hull. An output of the engine is transmitted to a drive shaft 47 through an elastic coupling 46. The drive shaft 47 thus rotates an impeller 48 of a water jet pump 6. The water sucked in is pressurized and ejected rearward by impeller 48 of the water jet pump 6 disposed on the rearward bottom portions of the hull 2. Thus, the small planing watercraft 1 is propelled to plane on the water surface.

Next, a general configuration of the engine 20 and an oil tank T1 according to the first embodiment will be explained with reference to FIG. 2. The engine 20 is a four-cycle four-cylinder engine and includes, from top to bottom, a cylinder head 21, a cylinder block 25, a crankcase 29, and an oil tank T1 with an oil pan 31. The cylinder head 21 has formed therein an intake air passage 22 and an exhaust gas passage 23. Valves for opening and closing the passages 22, 23 are installed in the cylinder head 21 together with a mechanism 24 for driving the valves. An air suction device 120 including intake manifold 12 with a carburetor 12A and an intake silencer 11 are connected upstream of the air intake passage 22, while a muffler 13 is connected downstream of the exhaust gas passage 23. Also, a piston 26 is slidably arranged in a cylinder liner 25A of the cylinder block 25. The space surrounded by the cylinder liner 25A, piston 26 and the cylinder head 21 defines a combustion chamber 27. A piston 26 is coupled to a crankshaft 28 supported on a crankcase 29 through bearings (not shown).

The crankcase 29 has a cylindrical wall 29W with a substantially inverted-Ω shaped cross section extending in the longitudinal direction of the crankshaft 28 defining the space in which the crankshaft 28 is allowed to rotate. An oil receptacle 32 is integrally formed with the oil pan 31 at the central portion thereof at the bottom of the cylindrical wall 29W and communicates with an internal space of the crankcase 29. The engine oil supplied to various parts of the engine body for lubrication and dropping from the crankshaft bearing and others are collected in the oil receptacle 32. Also, from top to sides of the oil tank T1 is formed integrally on both sides of the cylindrical wall 29W, utilizing the wall of the crankcase 29. The crankcase 29 is divided by a horizontal plane into an upper portion 29A and a lower portion 29B. The wall of the oil tank T1 is integrally formed with horizontally divided portions of the crankcase 29, and the wall of the oil tank T1 is also divided into a wall 30*a* of an upper tank portion 30A and a wall 30*b* of a lower tank portion 30B. Therefore, the oil tank is T1 is formed of three vertically arranged portions including the oil pan 31. These component parts are closely joined with each other to form the oil tank T1 integrated with the engine body. The oil tank T1 is formed on the air suction device side of the engine 20 (the left side in FIG. 2, hereinafter referred to as suction device side) and on the muffler side of the engine (the right side in FIG. 2, hereinafter referred to as muffler side). Both sides of the oil tank T1 are adapted to communicate with each other so that the engine oil is allowed to flow smoothly therebetween.

The engine oil collected in the oil receptacle 32 is sent to the oil tank T1 by a scavenging pump P1 through a strainer 35 to remove comparatively large foreign matter therefrom, and then through an oil passage 29C formed in the crankcase 29. The engine oil in the oil tank T1 is supplied by a feed pump P2 (located at the same position as the pump P1 in FIG. 2) to the various parts of the engine requiring the lubrication (including the cylinder head portions with a cam, the crankshaft bearing, the crank pin bearing, the gears and the sliding surface of the cylinder liner) through a fine strainer (not shown) and an oil passage formed in the engine body. The pumps P1, P2 are tandem trochoidal type mounted on the crankcase 29 and are driven by the crankshaft 28 through a driving gear G1 and a driven gear G2. As described above, the pumps P1, P2 and the oil passages connected therewith are located in the engine body, and therefore the external piping system for lubrication is not necessary. Internal gear pump, external gear pump or any other type of pumps can also be used as the pumps P1, P2.

The oil tank T1 is communicated with the interior of the air intake manifold 12 through a breather pipe 39 from the upper parts of the oil tank T1 on the suction device side and the muffler side of the engine 20. When the engine 20 is running, a blow-by gas and the engine oil introduced into the oil tank T1 from the crankcase 29 is separated in the oil tank T1. The blow-by gas separated in the oil tank T1 is sucked into the combustion chamber 27 through the breather pipe 39 and the air suction manifold 12. The breather pipe 39 is arranged to pass the height in the neighborhood of bottom of the oil tank T1. Consequently, even in the case when the small planing watercraft 1 turns over, and the oil tank T1 is upside down, and when the engine oil enters into the breather pipe 39, the engine oil is prevented from flowing out of the oil tank T1 because the portion of the breather pipe 39 at the height of the neighborhood of the bottom of the oil tank is then located above the oil level.

Figure 22A:
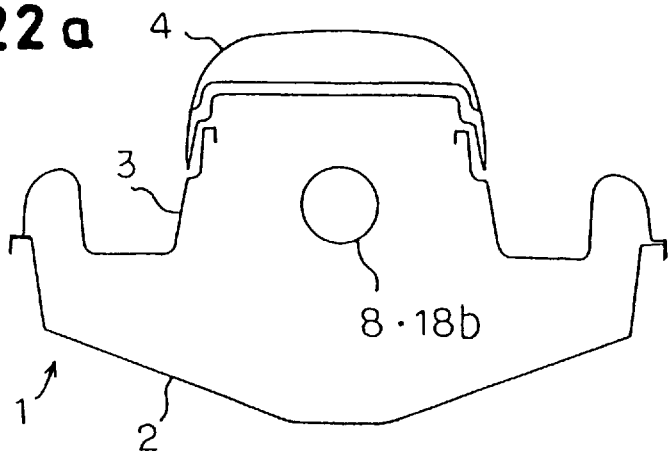
FIG. 22*a* is a schematic diagram showing a layout of the turn-over switch in the cross sectional view of the small planing watercraft.
Figure 22B:
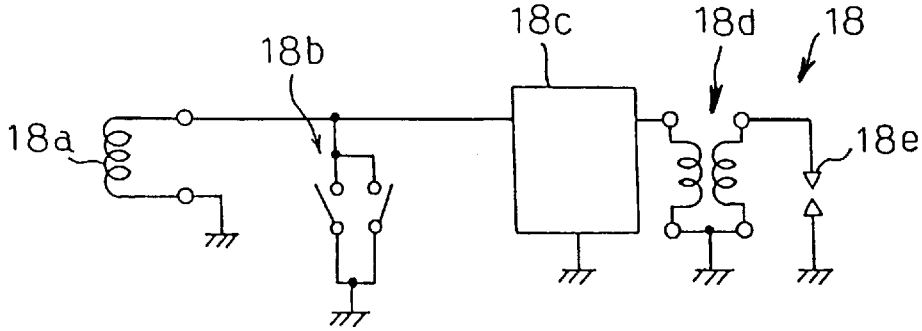
FIG. 22*b* is a circuit diagram showing the connections of the ignition device and the turn-over switch.
Figure 22C:
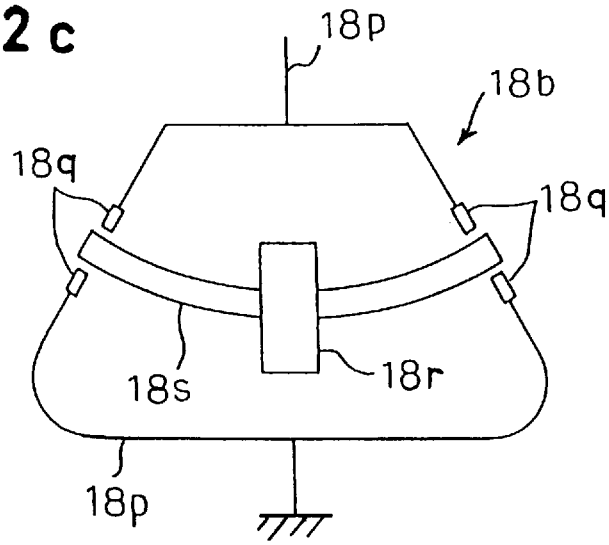
FIG. 22*c* is a schematic diagram showing a configuration of the turn-over switch.

The small planing watercraft 1 is equipped with a turn-over detection switch 18*b* as shown in FIGS. 22*a* to 22*c* for automatically stopping the engine 20 in case it turns over. The turn-over detection switch 18*b*, as shown in FIG. 22*a* and FIG. 1, is mounted in an electrical equipment box 8 (a sufficiently waterproof hermetic box to encase the electrical parts that are not waterproof) arranged inside the hull 2 of the small planing watercraft 1. The turn-over detection switch is connected to an ignition system 18 of the engine 20 as shown in FIG. 22*b*. In FIG. 22*b*, an exciter coil 18*a*, a CDI (capacitive discharge ignition) unit 18*c*, an ignition coil 18*d*, and a spark plug 18*e* constitute the ignition system 18. The turn-over detection switch 18*b* of a weight type shown in FIG. 22*c* is employed. Specifically, the circuit shown with a wire 18*p* having a grounded end includes a set of laterally (in the transverse direction of the hull) symmetric open contacts 18*q*, and a weight 18*r* is arranged slidably along a U-shaped track 18*s* formed between the contacts 18*q*. When the track 18*s* is tilted leftward or rightward at a predetermined angle (about, 60°) or more, the weight 18*r* that has correspondingly moved comes into contact with one of the contacts 18*q* and closes the circuit. Then, the output from the exciter coil 18*a* of the ignition system 18 shown in FIG. 22*b* thus is grounded to stop the engine 20.

With the above-mentioned configuration, when the small planing watercraft 1 turns over or is inverted in position, the engine 20 including the feed pump P2 immediately stops thereby to stop supplying the engine oil to the crankshaft 28 and others. As a result, the engine oil is prevented from flowing into the combustion chamber 27 from inside of the crankcase 29, and the spark plug 18*e* is not contaminated by the engine oil. Therefore the engine 20 can be restarted easily when the turned over small planing watercraft 1 is restored into normal position. Other types of switches can of course be used as the turn-over detection switch.

Figure 2:
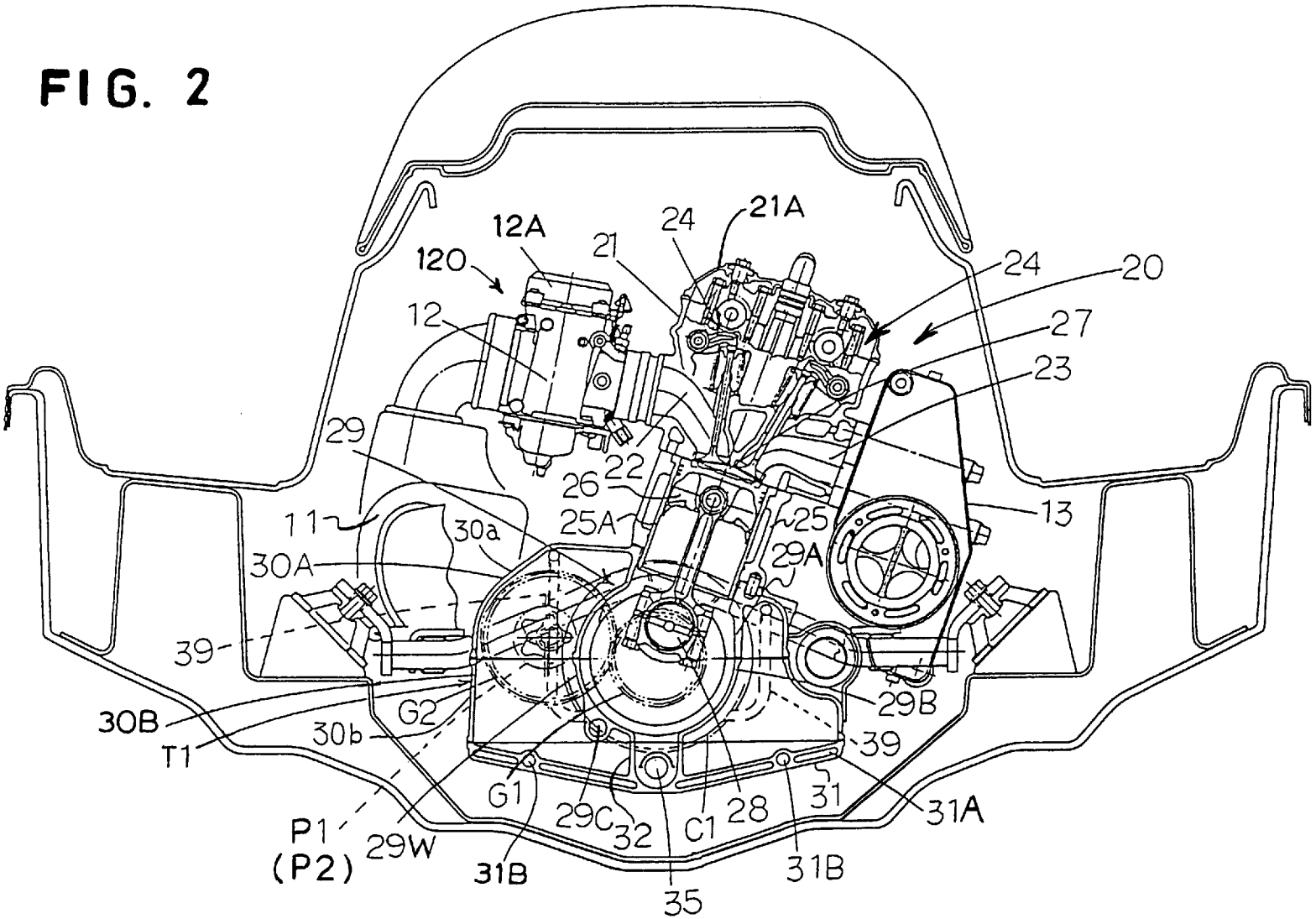
FIGS. 2 to 9 are cross sectional views of the internal combustion engine according to first to eighth embodiments of the invention.

Also, as shown in FIG. 2, the oil pan 31 of the engine 20 is formed with a water jacket 31A to which the water is admitted from a water intake fitting 7 mounted on the water jet pump 6 shown in FIG. 1. Specifically, one port 31B of the water jacket 31A is connected to the water intake fitting 7 through a tube (not shown), and the other port 31B is similarly connected to a cooling water coupling port (not shown) of the cylinder block 25 through a tube (not shown). The water from the water jet pump 6 is thus delivered to cool the cylinder block 25 and the cylinder head 21 after cooling the oil pan 31.

The engine 20 in the hull is so arranged, as shown in FIG. 2, that the crankshaft 28 is positioned in the longitudinal direction of the hull at the central portion in the lateral direction of the hull. At the same time, the cylinder 25 of the engine 20 is inclined rightward (to the right side in FIG. 2) as viewed in the forward direction of the hull. In this way, a space that can accommodate the air suction device 120 is secured in the upper left portion of the engine 20, and the air suction device such as the carburetor 12A is arranged in this space. The carburetor 12A and the other devices are thus arranged above in proximity to the cylinder 25, while at the same time reducing the deflection of the weight of the engine 20 to the right side of the hull. The center of gravity of the whole watercraft is thus positioned substantially at the center in the transverse direction of the watercraft.

Now, engines according to other embodiments of the invention will be explained with reference to FIGS. 3 to 13.

Figure 3:
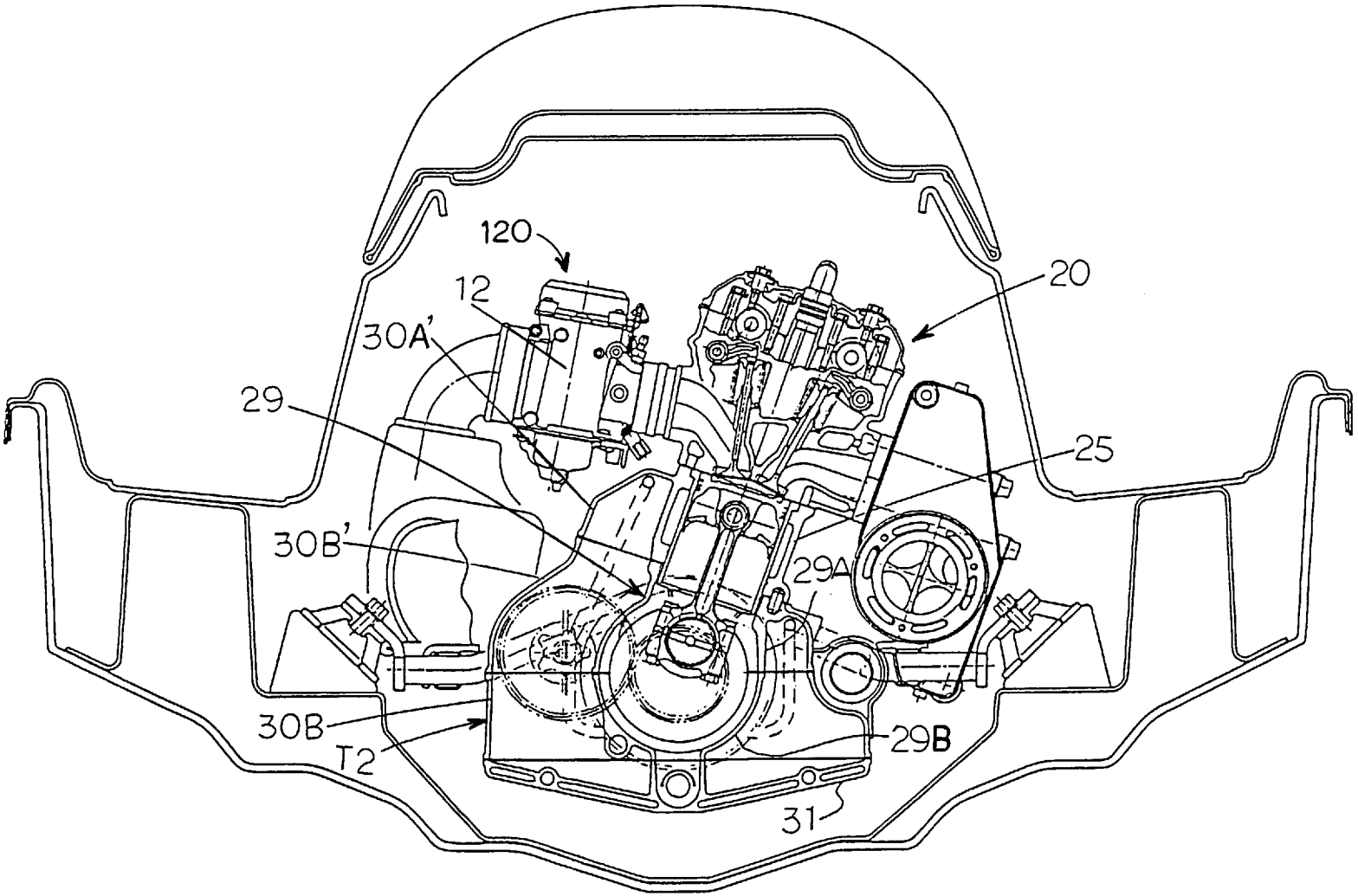

In an engine 20 according to a second embodiment shown in FIG. 3, an oil tank T2 has an upper portion thereof extended vertically up to a cylinder block 25 on the suction device side of the engine 20. Consequently, the oil tank T2 on the suction device side of the engine 20 is composed of three horizontally divided portions including an upper tank portion 30A' integrally formed with a cylinder block 25, an intermediate tank portion 30B' integrally formed with an upper portion 29A of a crankcase 29 and a lower tank portion 30B integrally formed with a lower portion 29B of the crankcase 29. Therefore, the oil tank T1 is formed of four vertically arranged portions including an oil pan 31. The configuration of the remaining parts is similar to that of the oil tank T1 according to the first embodiment. The oil tank T2 is intended to increase the capacity utilizing the space below the suction device 120 and further improves the separation of oil from the blow-by gas.

Figure 4:
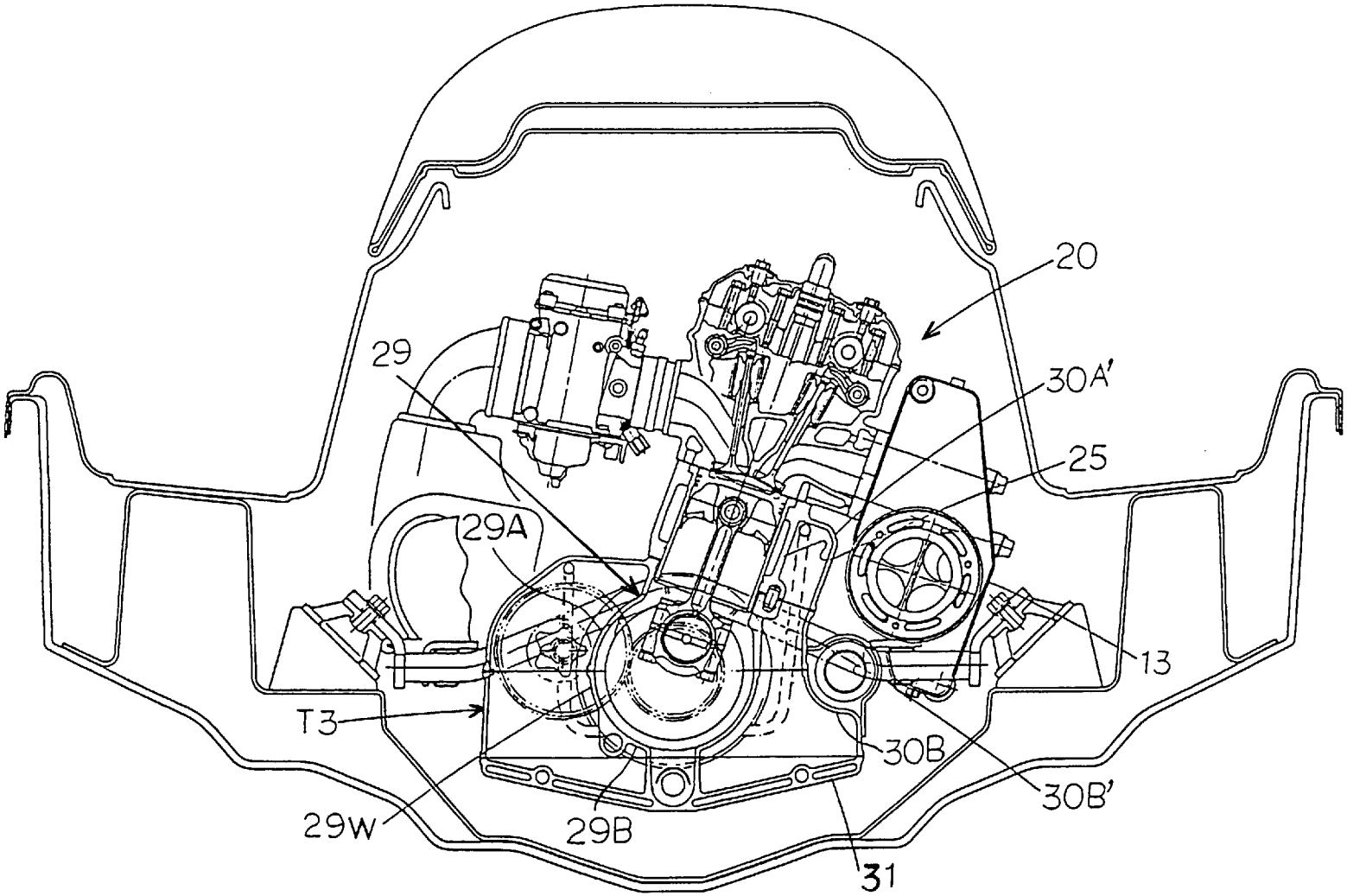

In an engine 20 according to a third embodiment shown in FIG. 4, an oil tank T3 has an upper tank portion thereof extended vertically up to the cylinder block 25 on the muffler side of the engine 20. Consequently, the oil tank T3 on the muffler side of the engine 20 is composed of three horizontally divided portions including an upper tank portion 30A' integrally formed with the cylinder block 25, an intermediate tank portion 30B' formed integrally with the upper portion 29A of the crankcase 29 and a lower tank portion 30B integrally formed with the lower portion 29B of the crankcase 29. Therefore, the oil tank T3 is formed of four vertically arranged portions including the oil pan 31. The configuration of the remaining parts is similar to that of the oil tank T1 according to the first embodiment. The oil tank T3 is intended to increase the capacity utilizing the space under the exhaust manifold 13 and further improves the separation of oil from the blow-by gas.

Figure 5:
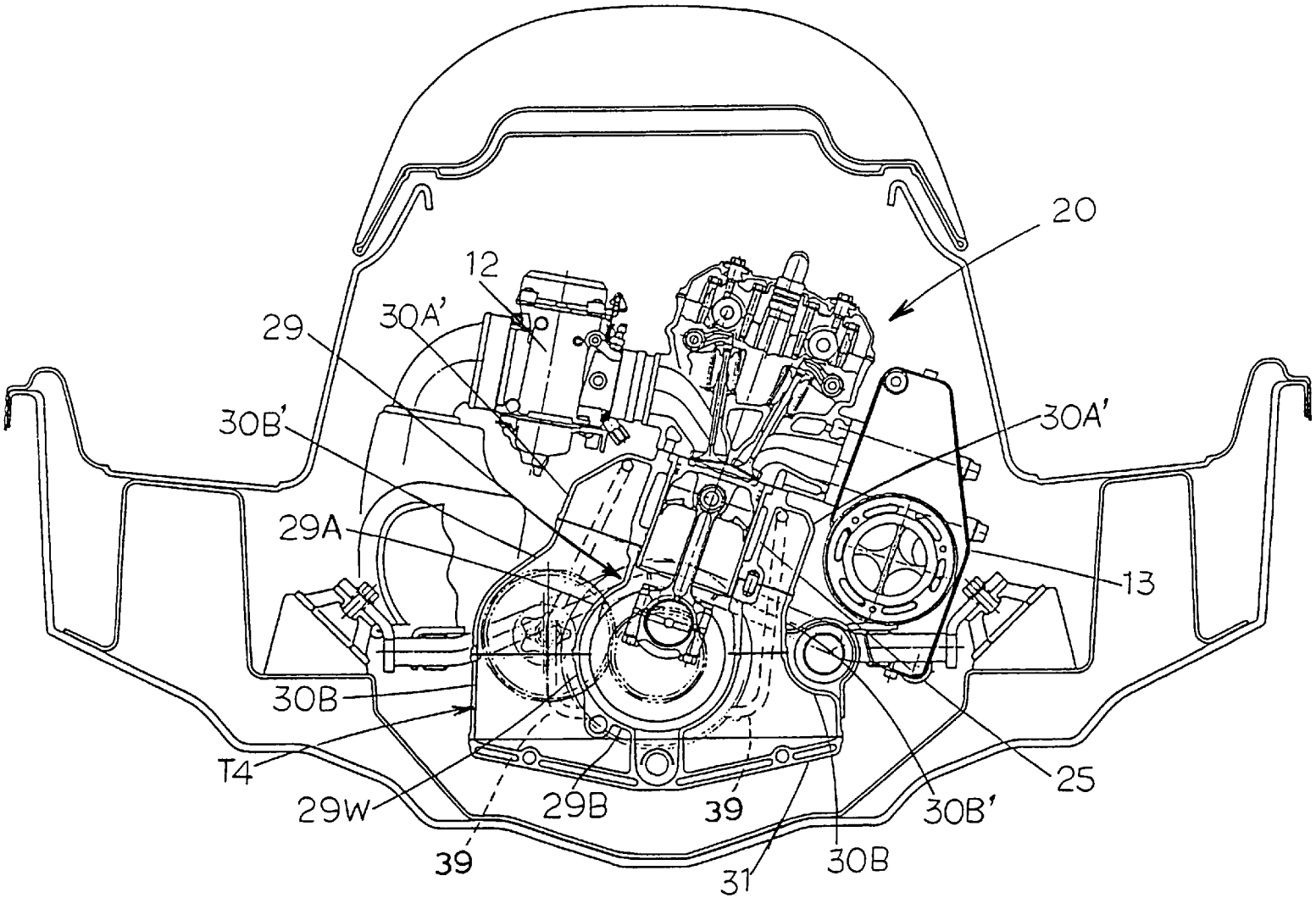

In an engine 20 shown in FIG. 5 according to a fourth embodiment of the invention, an oil tank T4 has the upper tank portions 30A' thereof vertically extended up to the cylinder block 25 on the suction device side and muffler side of the engine 20. Consequently, both the suction device side part and the muffler side part of the oil tank T4 are composed of three horizontally divided portions including an upper tank portion 30A' integrally formed with the cylinder block 25, an intermediate tank portion 30B' integrally formed with the upper portion 29A of the crank case and a lower tank portion 30B integrally formed with the lower portion 29B of the crank case 29. Therefore, the oil tank T4 is formed of four vertically arranged portions including the oil pan 31. The oil tank T4 is intended to utilize the space under the air intake manifold 12 and the exhaust gas manifold 13 to further increase the capacity thereof for an improved oil separability from the blow-by gas.

Figure 6:
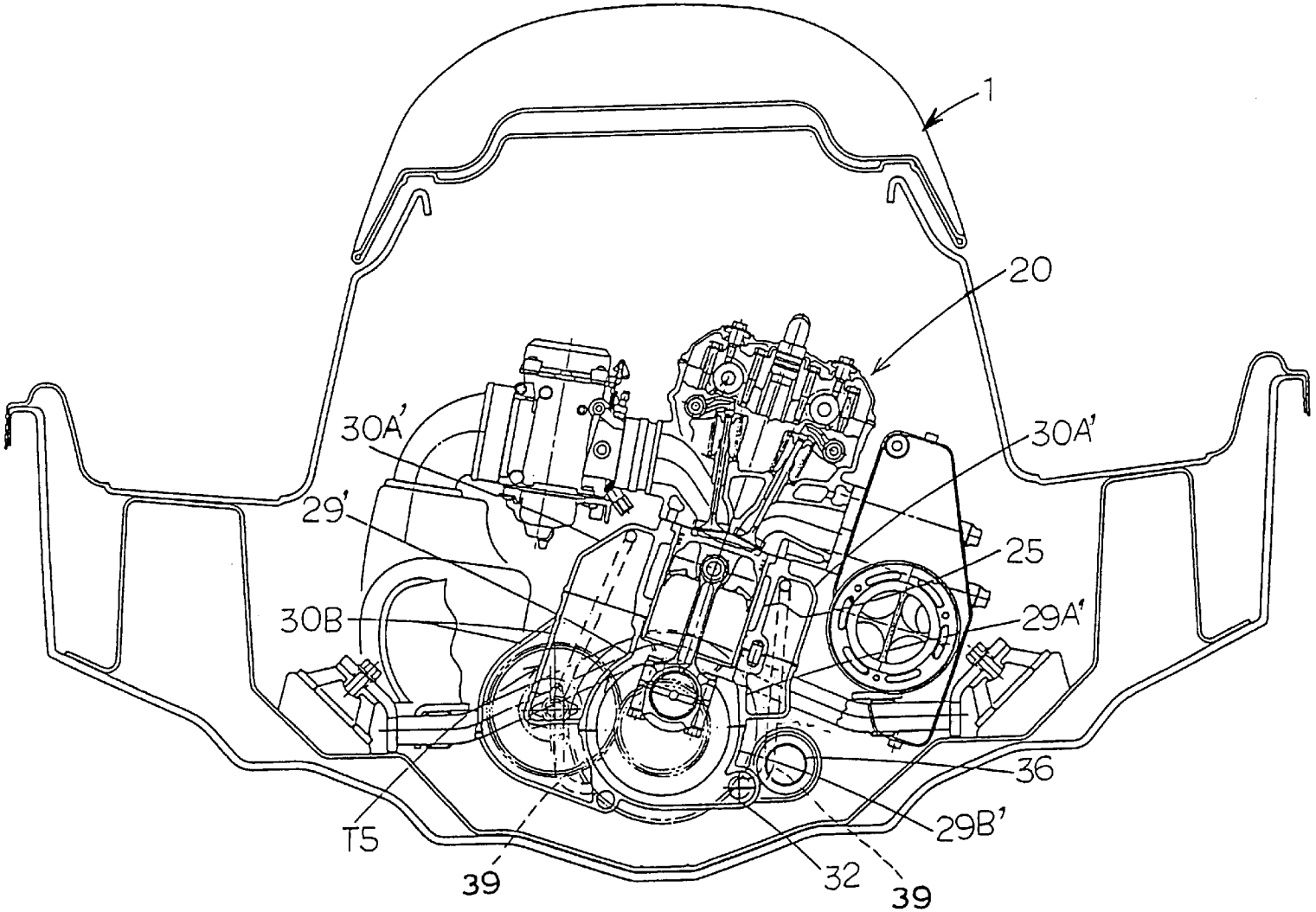

In an engine 20 shown in FIG. 6 according to a fifth embodiment, an oil tank T5 is similar to the oil tank T4 according to the fourth embodiment in that the upper tank portions 30A' are vertically extended up to the cylinder block 25 on both sides of the engine 20. The oil tank T5, however, is different from the oil tank T4 according to the fourth embodiment in that, the oil pan with the cooling jacket is eliminated and an oil receptacle 32 is integrally formed at the bottom portion of a crankcase 29' on the muffler side of the engine 20, and further the oil cooler 36 is arranged on the muffler side of the engine 20 at the lower portion 29*b*' of the crankcase 29, and no tank portion is formed on the lower portion 29*b*' of the crankcase 29. The oil tank T5, on both sides of the engine 20, has the upper tank portion 30A' integrally formed with the cylinder block 25 and the lower tank portion 30B with a bottom integrally formed with the upper crankcase 29A'. In the oil tank T5, therefore, the engine height is reduced because the oil pan is eliminated, and the center of gravity of the small watercraft 1 is correspondingly lowered.

Figure 7:
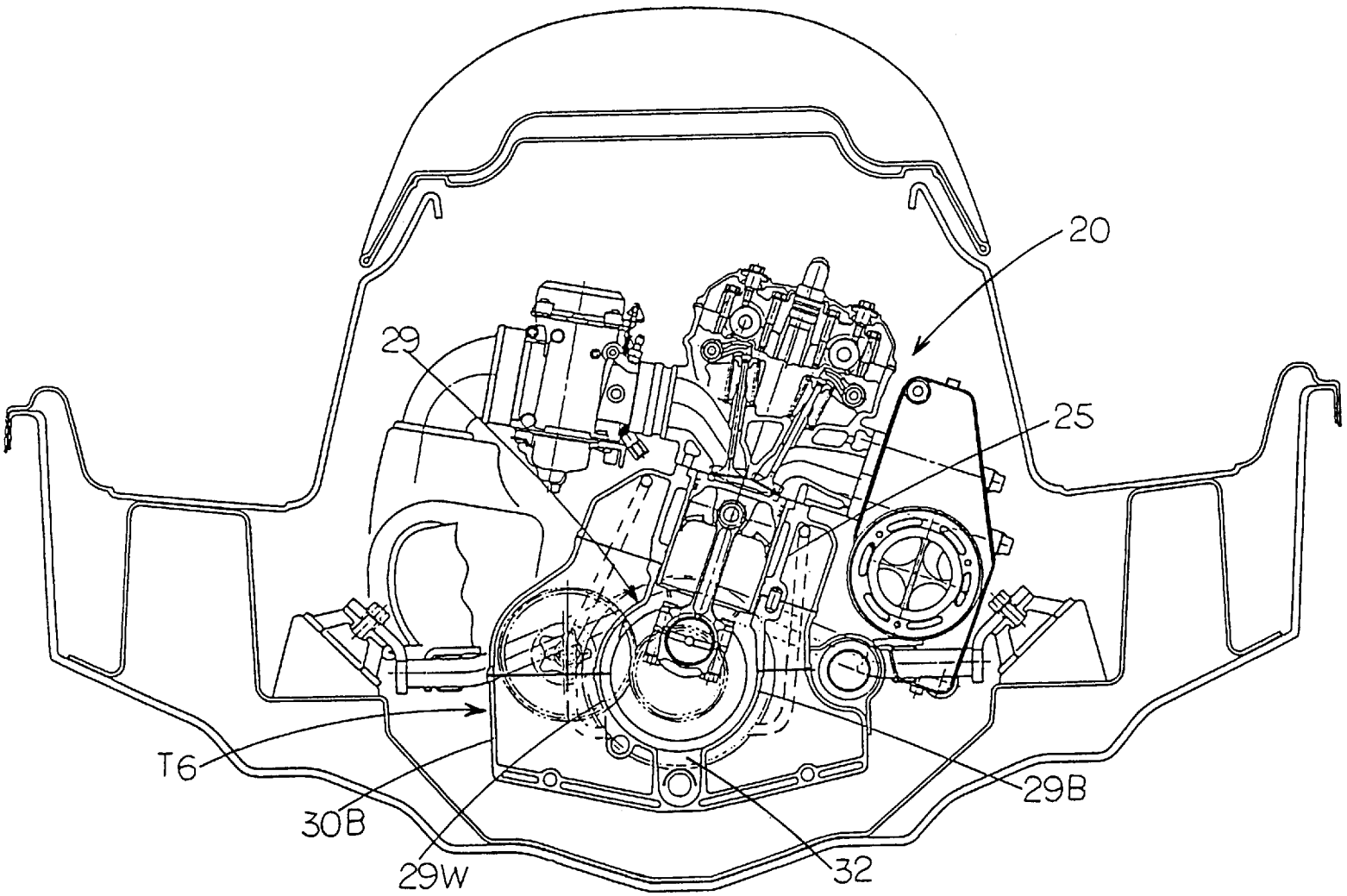

In an engine 20 shown in FIG. 7 according to a sixth embodiment, an oil tank T6 is similar to the oil tank T4 according to the fourth embodiment in that the upper tank portion 30A is extended up to the cylinder block 25 on the suction device and the muffler sides of the engine 20. Nevertheless, the portion of the oil tank T6 corresponding to the oil pan including the oil receptacle 32 of the oil tank T4 is integrally formed with a lower portion 29B of a crankcase 29 and a lower tank portion 30B of the oil tank T6, so that the tank is composed of three vertically arranged portions. Consequently, unlike the fourth embodiment, this embodiment eliminates the need of mounting the oil pan.

Figure 8:
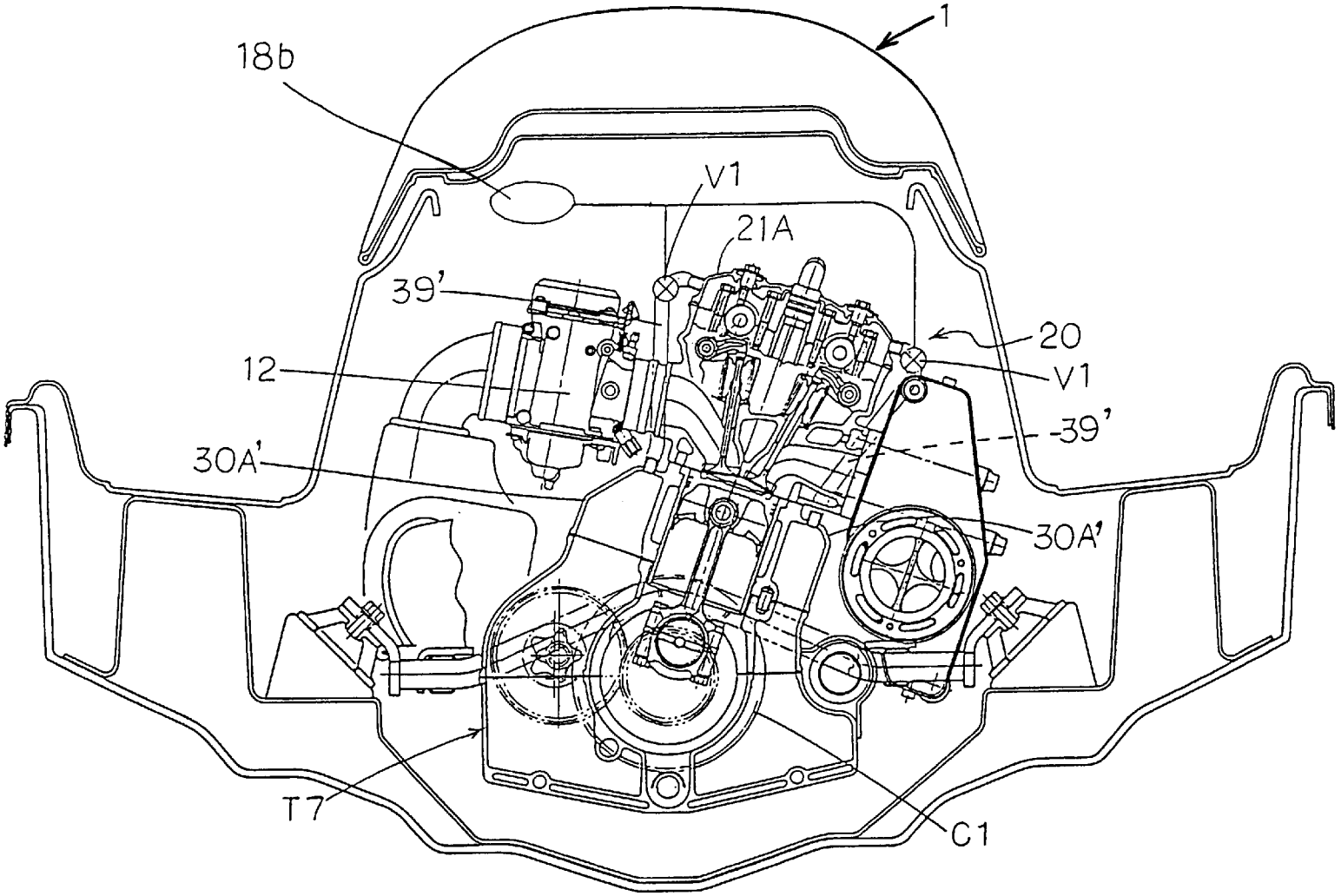

In an engine 20 shown in FIG. 8 according to a seventh embodiment, an oil tank T7 has a configuration similar to the sixth embodiment except for a breather pipe. On both sides of the engine 20, the breather pipe 39' connected to the upper portion 30A' of the oil tank T7 is arranged (not shown) to communicate with the air intake manifold 12 through a cylinder head cover 21A (or directly to the air intake manifold 12) without detouring to the neighborhood of the bottom portion of the oil tank. The breather pipe 39' includes a solenoid valve V1 controlled by the signal from the turn-over detection switch 18*b* described above. With this configuration, the engine 20 is stopped and the solenoid valve V1 is closed when the small planing watercraft turns over, and the engine oil is prevented from flowing out of the oil tank without the detouring of the breather pipe. Therefore, the breather pipe can be reduced in length and simplified.

Figure 9:
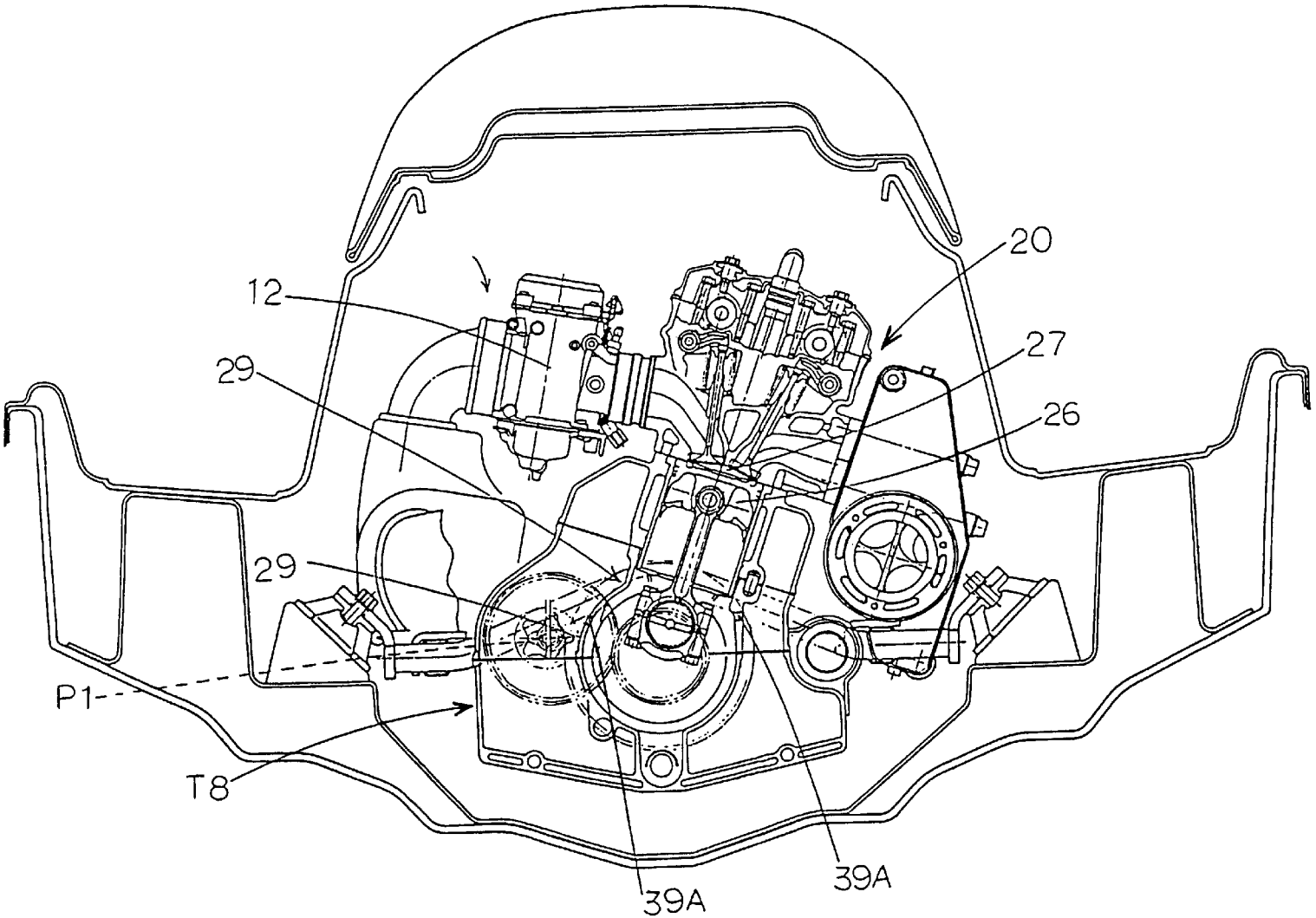

In an engine 20 shown in FIG. 9 according to an eighth embodiment, an oil tank T8 has the same configuration as that of the sixth embodiment except that the breather pipe is eliminated. In place of the breather pipe, breather holes 39A communicating between the interior of the oil tank T8 and the interior of the crankcase 29 are formed on both sides of the upper potion 29A of the crankcase at substantially the central height of the oil tank T8 above the oil level in the oil tank T8. The interior of the crankcase 29 is affected by the pumping action due to the reciprocation of a piston 26. The sucking function of the scavenging pump P1, however, causes the blow-by gas to move relatively smoothly from the oil tank T8 through the breather holes 39A into the crankcase 29. The blow-by gas is further introduced from the interior of the crankcase 29 through a breather unit (not shown) into the suction device. Instead of introducing the blow-by gas from the crankcase 29 into the suction device 120 through a breather units described above, a breather passage from the oil tank T8 to the suction device may be provided for introducing the blow-by gas without passing through the crankcase 29. When the small planing watercraft turns over, the engine oil in the oil tank T8 flows over the breather holes 39A, however, the amount of the engine oil which flows into the crankcase 29 through the breather holes 39A is small. Therefore, no engine oil flows into the combustion chamber 27. Also, when the oil tank is inverted in position, the breather holes 39A located substantially at the central height of the oil tank T8 still remain above the oil level, and therefore the engine oil is prevented from flowing into the crankcase 29. As a result, the engine oil would not flow into the combustion chamber.

Figure 10:
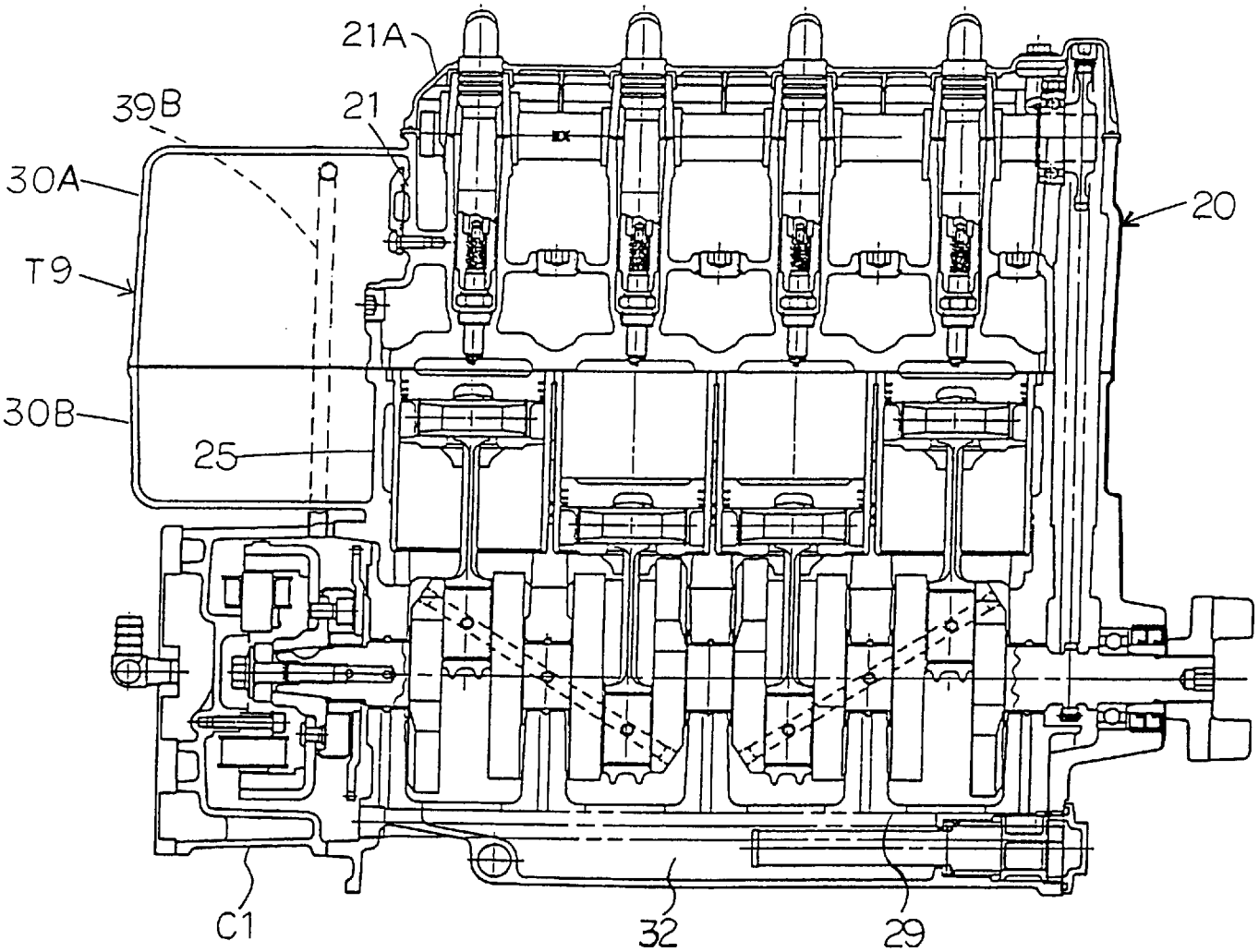
FIGS. 10 to 13 are longitudinal sectional views of the internal combustion engine according to ninth to 12th embodiments of the invention.

In an engine 20 shown in FIG. 10 according to a ninth embodiment, an oil tank T9 is arranged above a generator case C1 on the front side of the engine 20 (in the forward direction of the small planing watercraft 1, i.e., on the left side in FIG. 10). The oil tank T9 is composed of an upper tank portion 30A and a lower tank portion 30B integrally formed with the front portion of the cylinder head 21 and the front portion of the cylinder block 25, respectively. The upper tank portion 30A is connected with a breather pipe 39B communicating with the air intake manifold through the generator case C1 located below the oil tank T9. The crankcase 29 and the oil receptacle 32 are preferably so configured that the oil receptacle 32 is integrally formed with one side of the bottom portion of the crankcase 29 as in the fifth embodiment (FIG. 6), however, an oil receptacle may alternatively be protruded from the central bottom portion of the crankcase 29 as in the sixth embodiment (FIG. 7). The oil tank T9 is intended to increase the capacity by utilizing the space above the generator case C1 and thus improve the oil separability from the blow-by gas.

Figure 11:
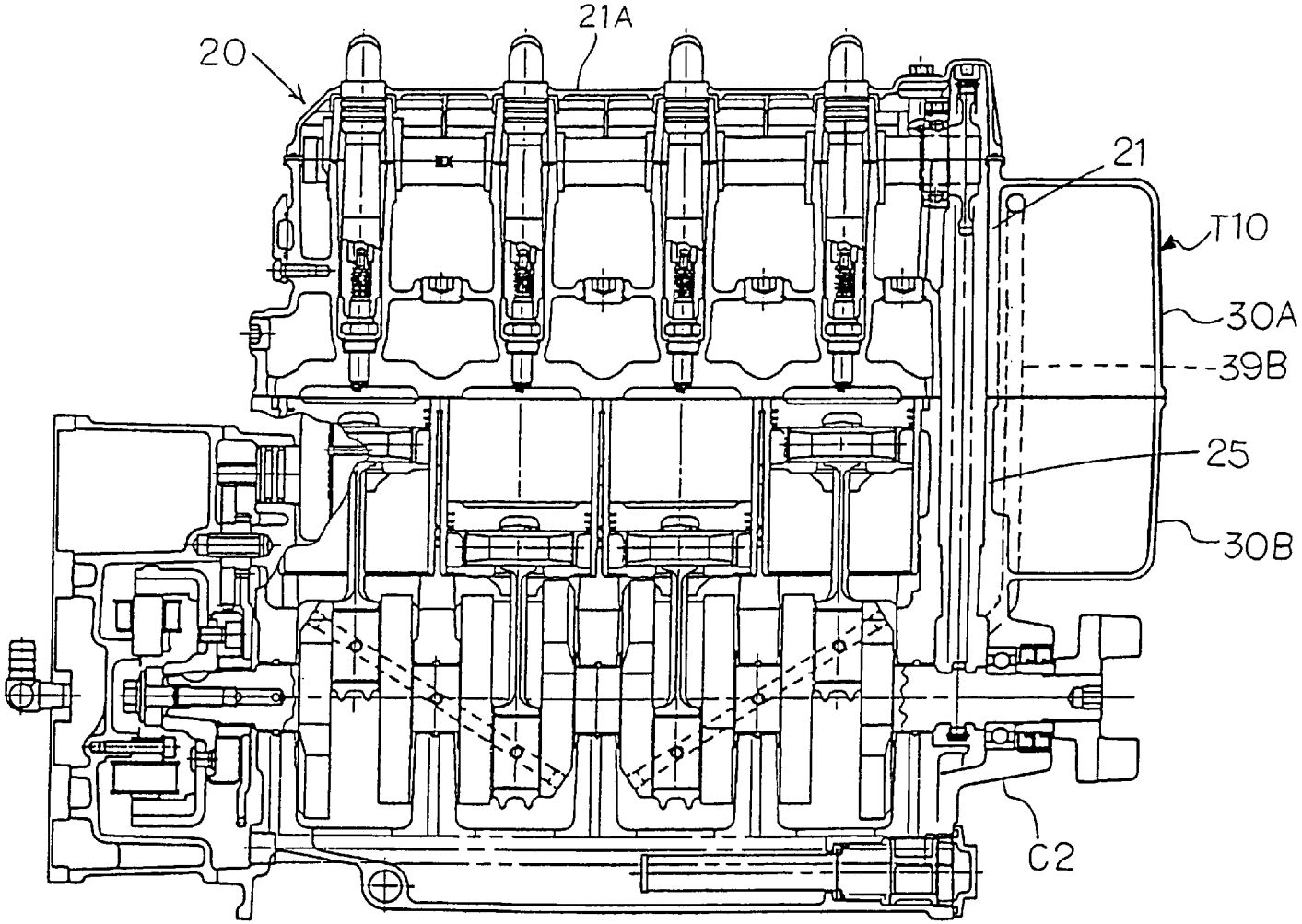

In the engine 20 shown in FIG. 11 according to a tenth embodiment, an oil tank T10 is arranged above a coupling case C2 on the rear side of the engine 20 (in the backward direction of the small watercraft 1, i.e., on the right side in FIG. 11). The oil tank T10 is composed of an upper tank portion 30A and a lower tank portion 30B integrally formed with the rear portion of the cylinder head 21 and the rear portion of the cylinder block 25, respectively. The upper tank portion 30A is connected with a breather pipe 39B communicating with the air intake manifold through the coupling case C2 located below the oil tank. The oil tank T10 is intended to increase the capacity utilizing the space above the coupling case C2 and improves the oil separability from the blow-by gas.

Figure 12:
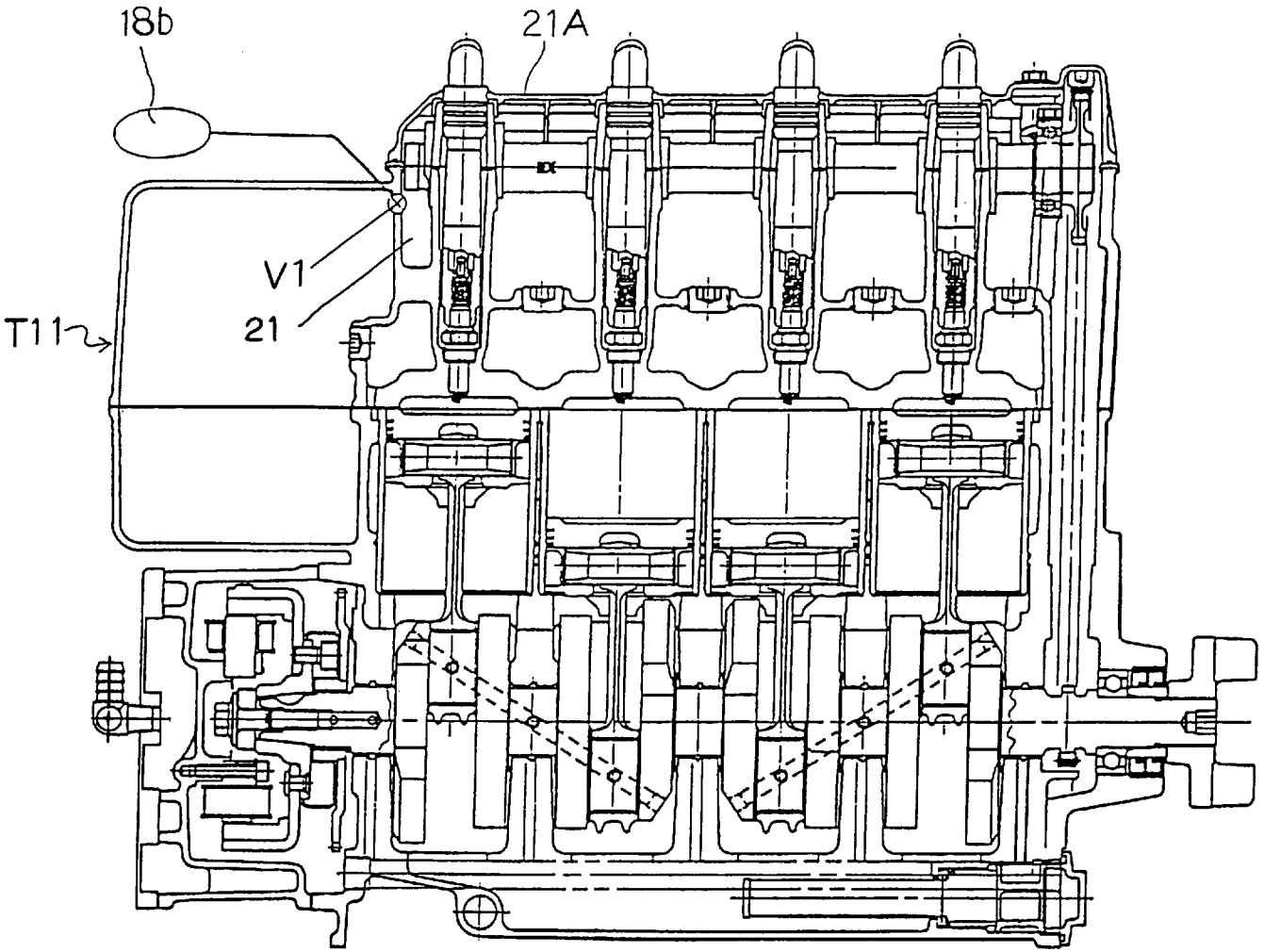
Figure 13:
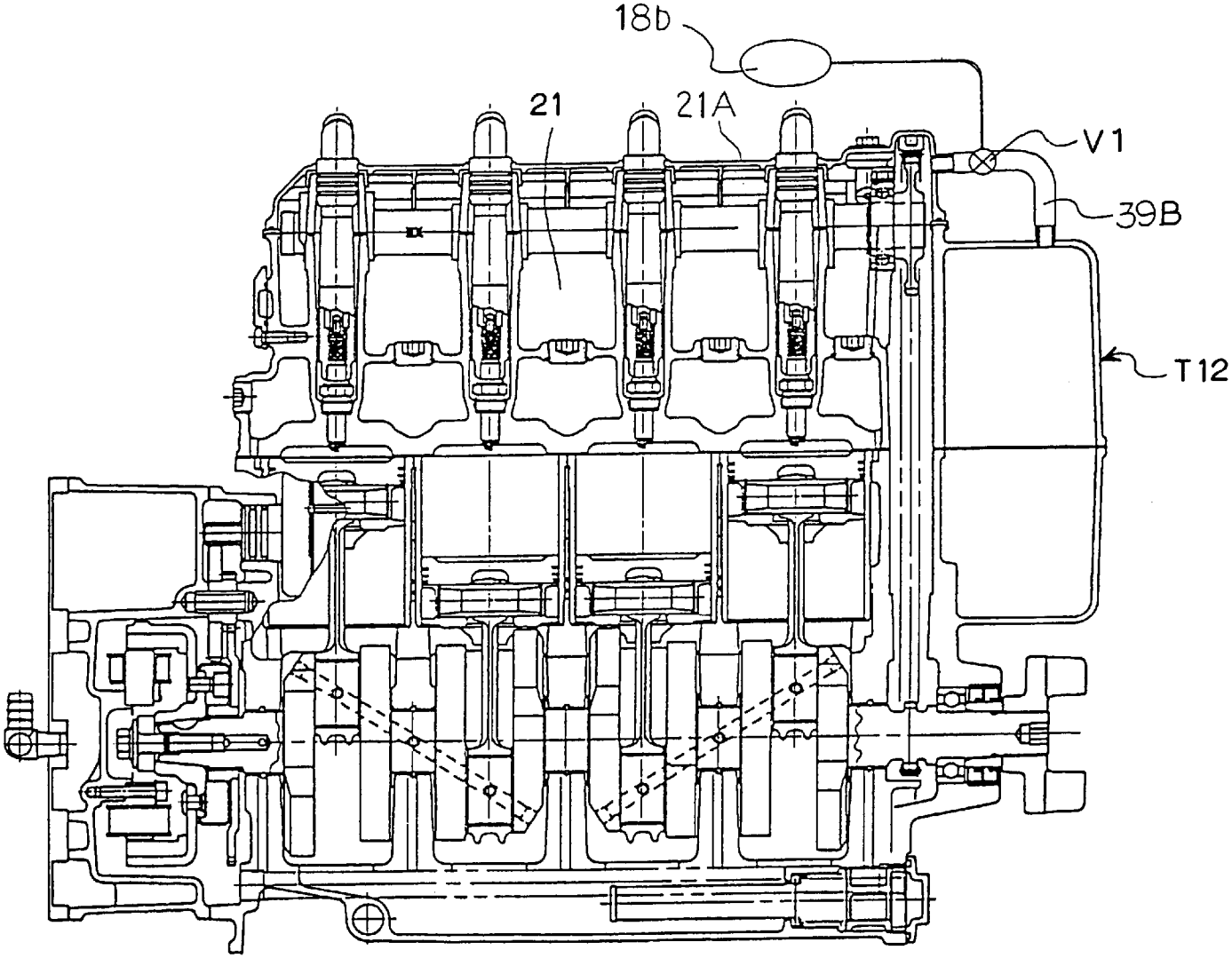

In an oil tank T11 shown in FIG. 12 according to an eleventh embodiment and an oil tank T12 shown in FIG. 13 according to a twelfth embodiment, are similar to the oil tank T9 according to the ninth embodiment and the oil tank T10 according to the tenth embodiment, respectively. In the oil tank T11 or the oil tank T12, however, the breather passage communicating between a cylinder head 21 and the oil tank T11, or cylinder head cover 21A and the oil tank T12, includes a solenoid valve V1 connected with the turn-over detection switch 18*b* described above. Also, the oil tank T11 lacks the breather pipe, and the oil tank T12 has the breather pipe 39B from the upper surface of the oil tank T12 coupled directly to the cylinder head cover 21A. Therefore, when the small planing watercraft is turned over, the solenoid valve V1 on the breather passage 39B is closed by a control signal from the turn over detection switch 18*b*, so that the engine oil is prevented from flowing out of the oil tank. The breather pipe can thus be eliminated or considerably reduced in length, therefore the breather passage can be simplified.

With the first to twelfth embodiments described above, the oil tank is integrally formed with the engine body. As compared with a four-cycle engine with a dry sump lubrication system with a separately mounted oil tank, the internal combustion engine of the present invention is reduced in size and weight, and the engine body is increased in rigidity. Also, the simplified lubrication piping system can save the mounting space in the small planing watercraft.

Now, with reference to FIGS. 14 to 21, other embodiments will be explained in which an oil tank includes a tank base portion TB integrally formed with the wall of the engine body and a tank cover TC mounted on the tank base portion TB.

The engines 20 are also four-cycle four-cylinder engines like the engines shown in FIGS. 2 to 13, with the cylinder block 25 and a crankcase 29 arranged under a cylinder head 21. According to the embodiments described below, as described in the fifth embodiment, the oil receptacle 32 is integrally formed on a bottom portion of a crankcase 29 on the muffler side thereof, and further, an oil cooler 36 is arranged on the muffler side of the lower portion 29*b* of the crankcase 29.

Figure 14:
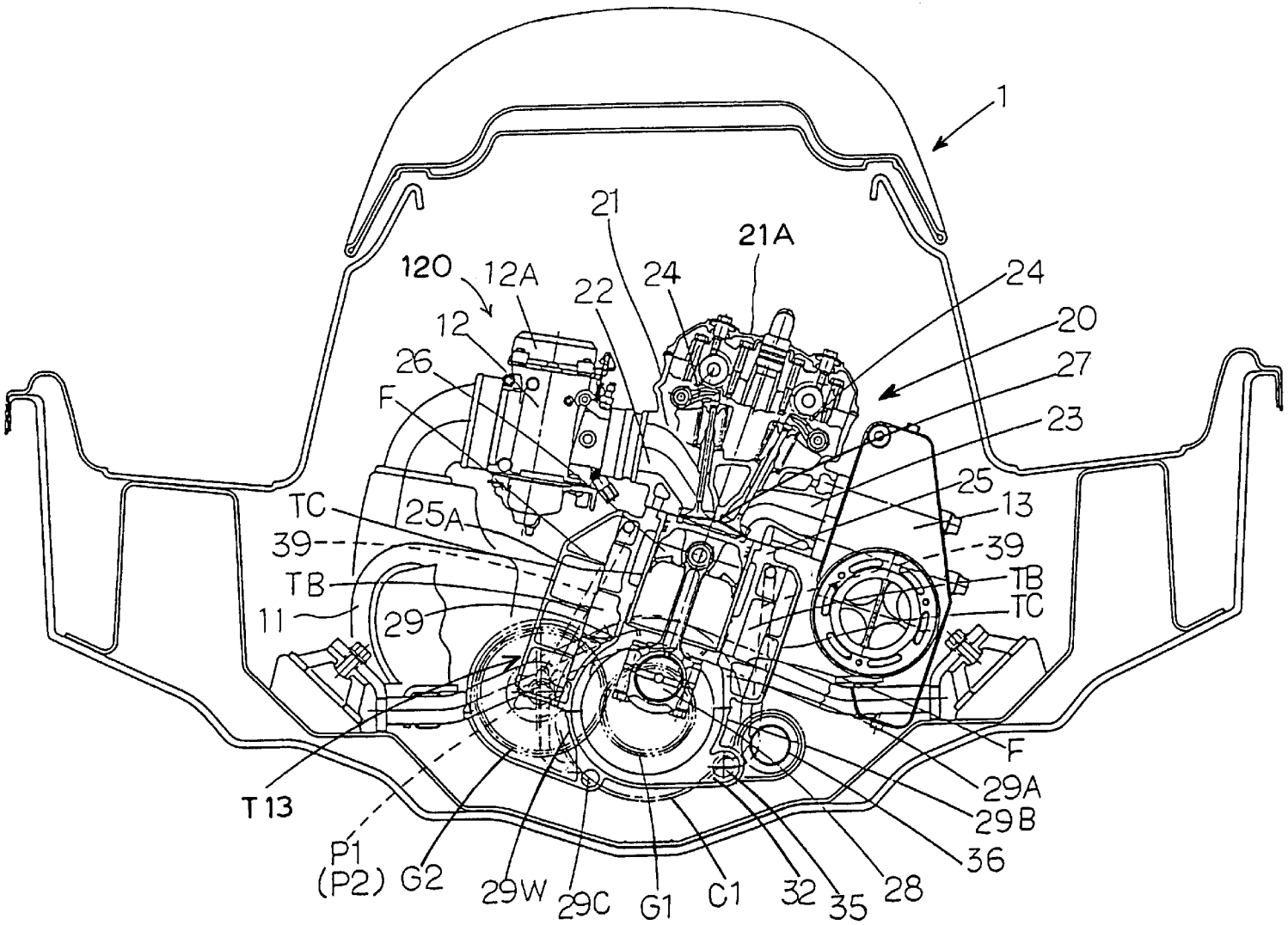
FIGS. 14 to 17 are cross sectional views of the internal combustion engine according to 13th to 16th embodiments of the invention.

According to a thirteenth embodiment shown in FIG. 14, an oil tank T13 is intended to increase the capacity by utilizing the space under an air intake manifold 12 and an exhaust gas manifold 13. The oil tank T13 includes a tank base portion TB integrally formed on both sides of an upper portion 29A of a cylindrical wall 29W of a crankcase 29 and the cylinder block 25 integrally formed with each other, and a tank cover TC mounted closely from outside.

The tank base portion TB and the interior of the tank cover TC have formed therein a plurality of oil mist separating fins F in staggered opposed relation to each other. A labyrinth passage formed by these fins F separates the blow-by gas and the engine oil brought into the oil tank T13 from the crankcase 29 and recovers the engine oil as oil drips and thus reduces oil consumption brought out with the blow-by gas from the oil tank T13, while at the same time reducing the contamination of the breather passage by the oil. Also, the fins F immersed in the engine oil stabilize the oil level against fluctuation due to turning, rolling or pitching of the small planing watercraft 1 and prevents the air from being sucked into the feed pump P2. Thus proper amount of engine oil can always be supplied to the various parts of the engine.

Figure 15:
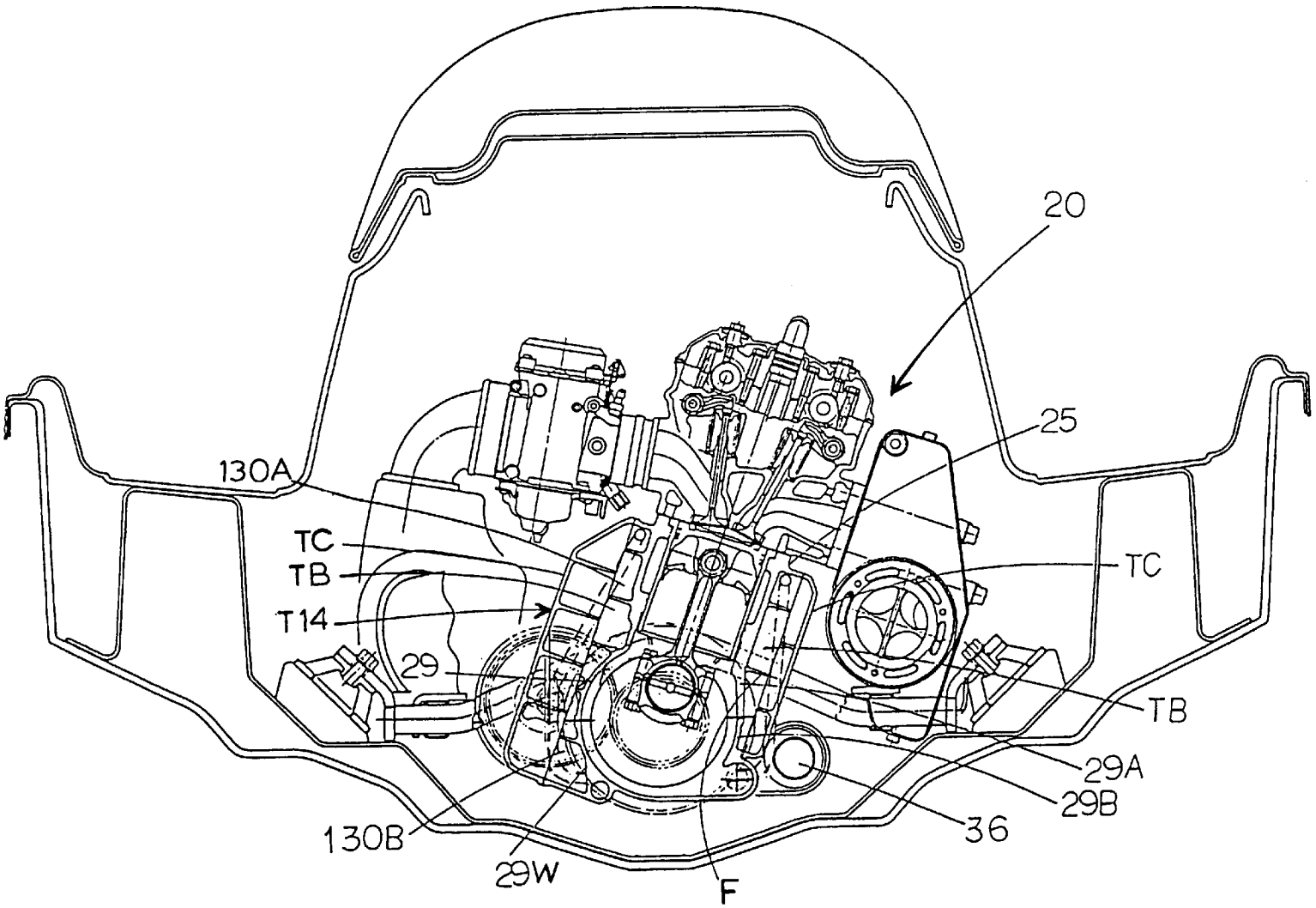

In the engine 20 shown in FIG. 15 according to a fourteenth embodiment, an oil tank T14 is intended to increase the capacity by being extended from the cylinder block 25 to the lower portion 29B of the crankcase 29 on both sides as in the 13th embodiment described above. A tank base portion TB is composed of two portions including an upper base portion 130A and a lower base portion 130B. The upper base portion 130A is formed integrally on both sides of the cylinder block 25 and the upper portion 29A of the crankcase 29 integrally formed with each other. On the one hand, the lower base portion 130B is formed integrally on the lower portion 29B of the crankcase 29 formed separately from the integrally formed cylinder block 25 and the upper portion 29A of the crankcase 29. As a result, after the lower portion 29B of the crankcase 29 is closely joined to the upper portion 29A thereof, the tank cover TC is mounted on to cover the upper base portion 130A and the lower base portion 130B from outside to form the oil tank T14. The tank T14 has the features similar to those of the 13th embodiment described above except that the lower tank portion 30B is extended to the lower end of the lower portion 29B of the crankcase 29.

Figure 16:
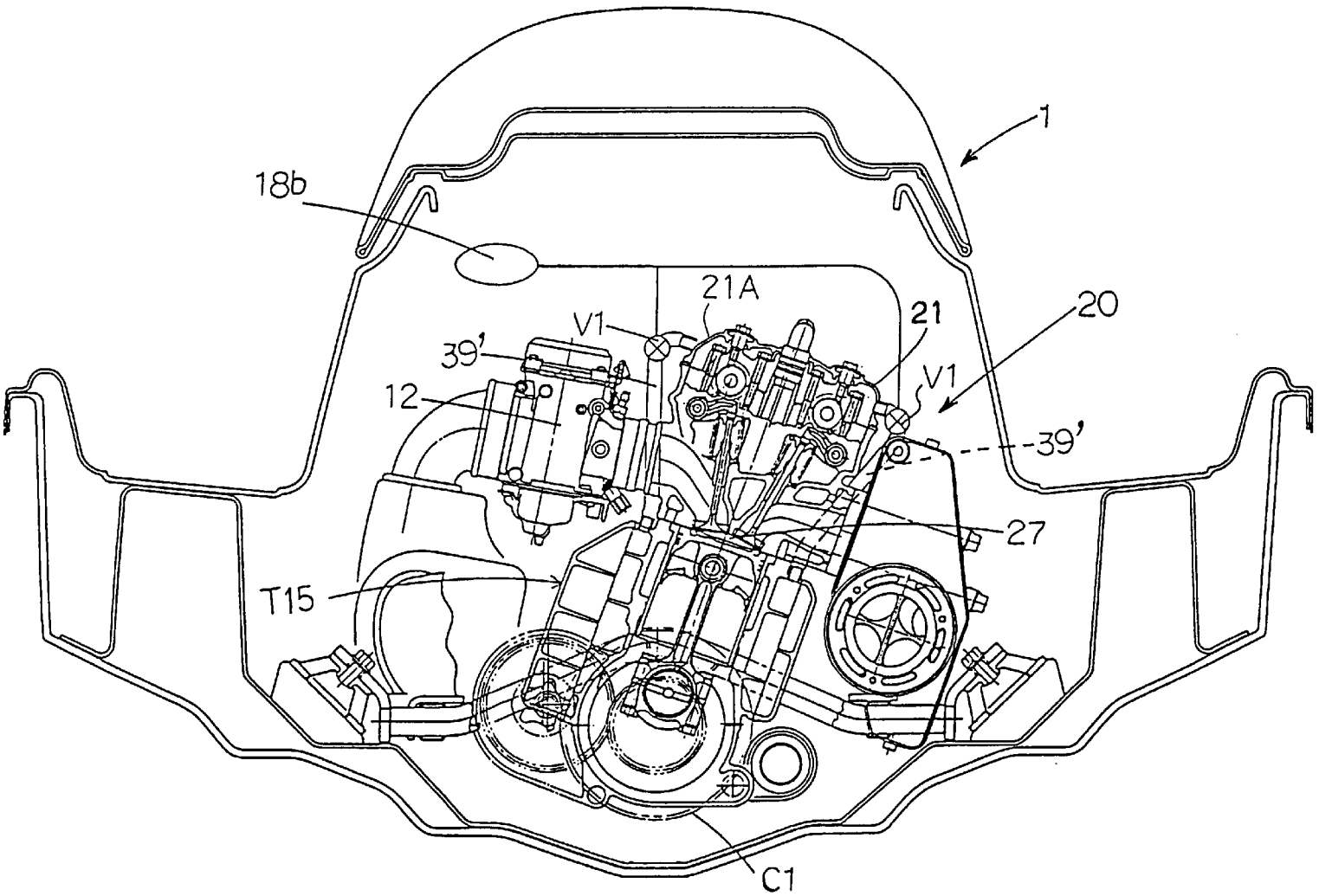

In an engine 20 shown in FIG. 16 according to a fifteenth embodiment, an oil tank T15 has a configuration similar to that of the thirteenth embodiment described above except for the configuration of the breather pipe. The breather pipes 39' connected to the upper tank portions on the suction device side and muffler side of the engine 20 are arranged to communicate with interior of the air intake manifold 12 through the cylinder head cover 21A (or directly with the interior of the air intake manifold 12) without detouring to the neighborhood of the bottom portion of the tank. Each breather pipe 39' includes a solenoid valve V1 operatively controlled by the signal from the turn-over detection switch 18*b* having the above-mentioned configuration. With this configuration, like in the oil tank T7 according to the seventh embodiment described above, the engine 20 stops when the small planing watercraft turns over and the oil can be prevented from flowing out of the oil tank without detouring of the breather pipes 39'. Therefore, the breather pipe can be considerably reduced in length and simplified.

Figure 17:
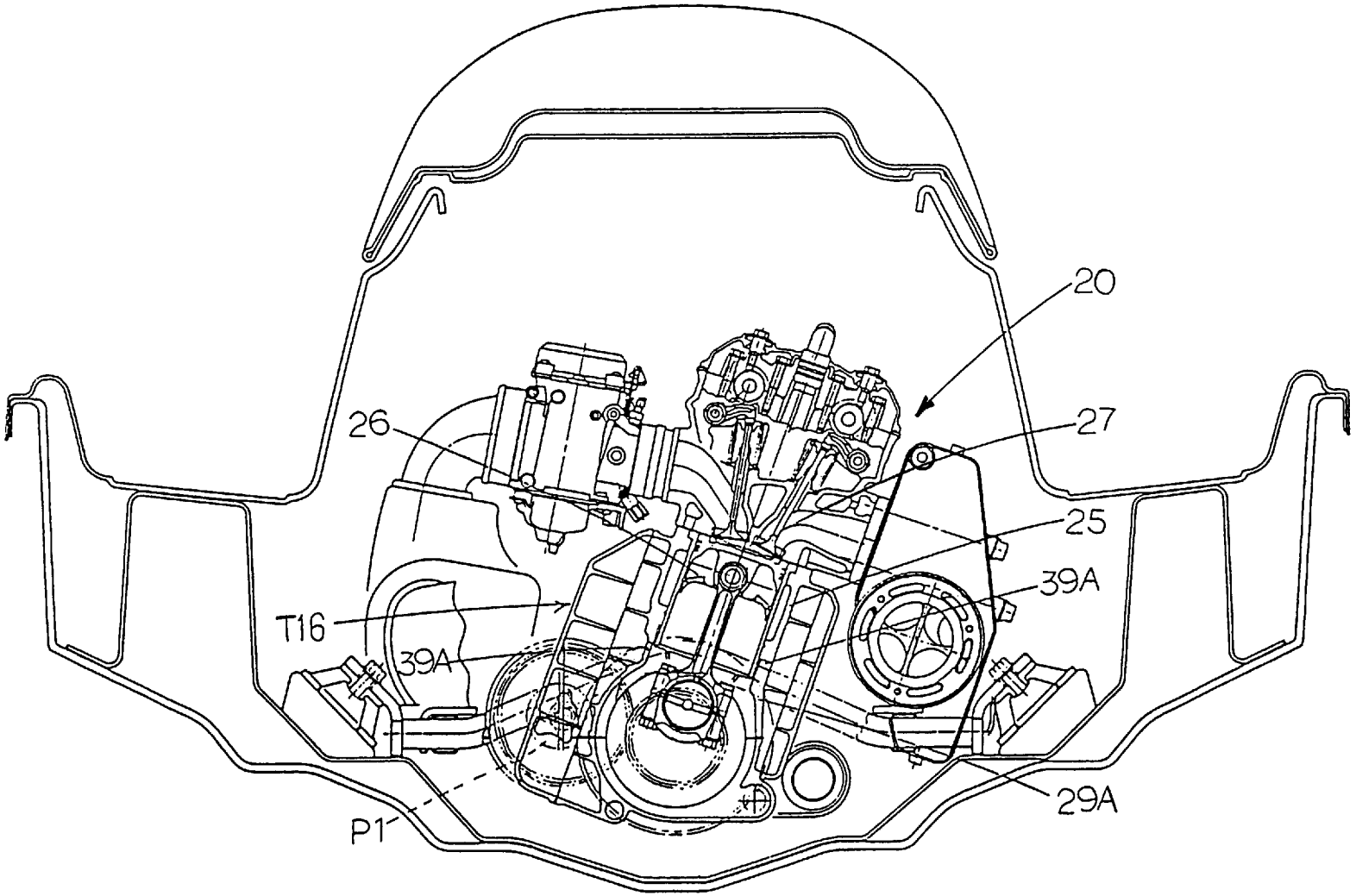

As shown in FIG. 17, an oil tank T16 for the engine 20 according to the sixteenth embodiment has the same configuration as that of the fourteenth embodiment except the breather passage is eliminated. Specifically, in place of the breather pipe, breather holes 39A communicating between the interior of the oil tank T16 and the interior of the crankcase 29 are formed on both sides of the upper portion 29A of the crankcase 29 substantially at the central height of the oil tank T16 above the oil level in the oil tank T16.

Figure 18:
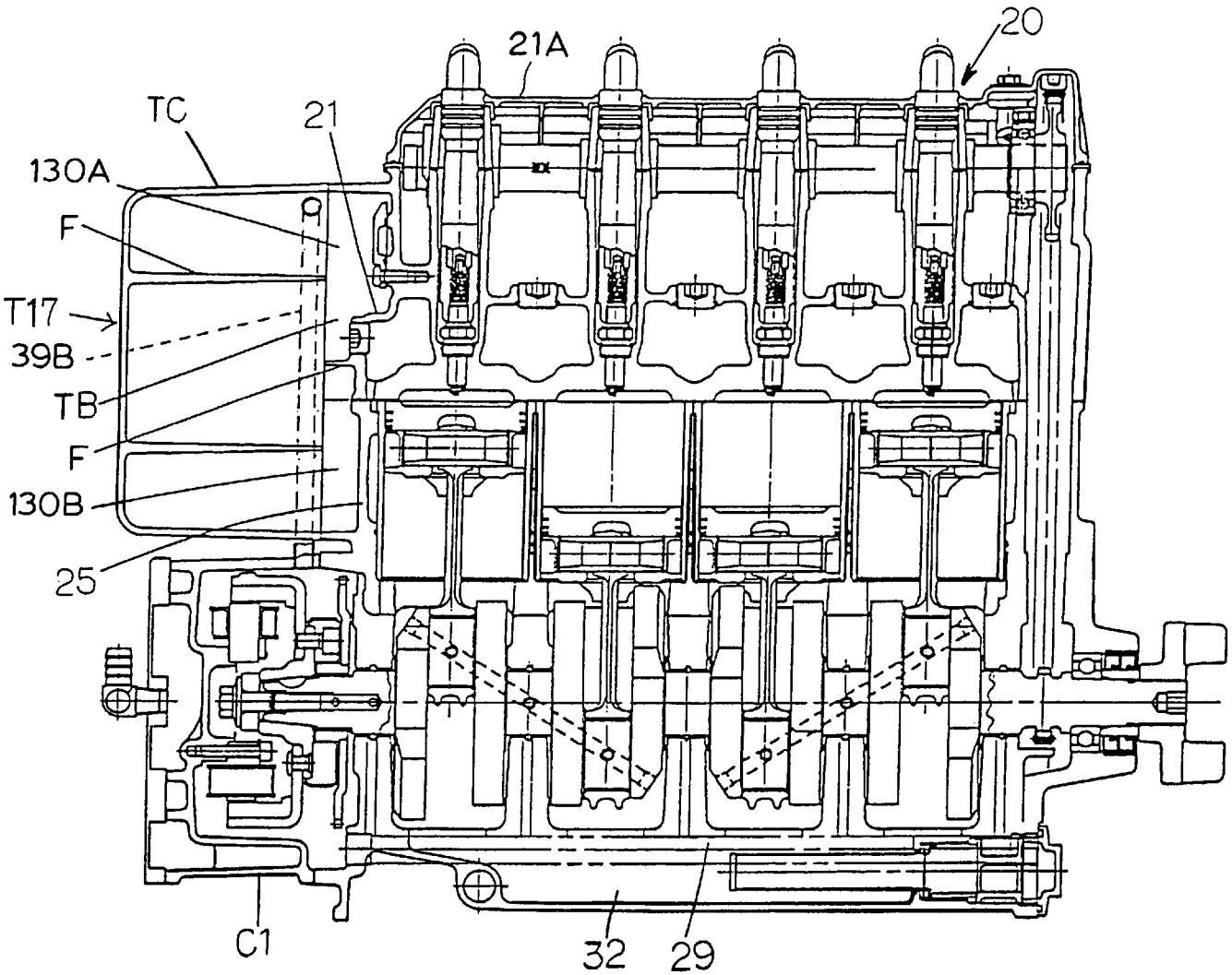
FIGS. 18 to 21 are longitudinal sectional views of the internal combustion engine according to 17th to 20th embodiments of the invention.

A In an engine 20 shown in FIG. 18 according to a seventeenth embodiment, an oil tank T17 is arranged above a generator case C1 in front of the engine. The tank base portion TB includes an upper base portion 130A integrally formed with the front portion of the cylinder head 21 and a lower base portion 130B integrally formed with the front portion of the cylinder block 25. These components are closely joined with each other, and then the tank cover TC is mounted closely from outside to form the oil tank T17. A plurality of oil mist separator fins F are formed in staggered opposed relation to each other in the tank base portion TB and the tank cover TC. A breather pipe 39B is communicated between the upper portion of the oil tank T17 and the generator case C1, and the blow-by gas is introduced into the suction device through the generator case C1. The oil tank T17, like the oil tank T9 according to the ninth embodiment, is intended to increase the capacity taking advantage of the space above the generator case C1. In addition, the fins F in the tank promote the separation of the oil mist from the blow-by gas brought in with the oil from the crankcase 29.

Figure 19:
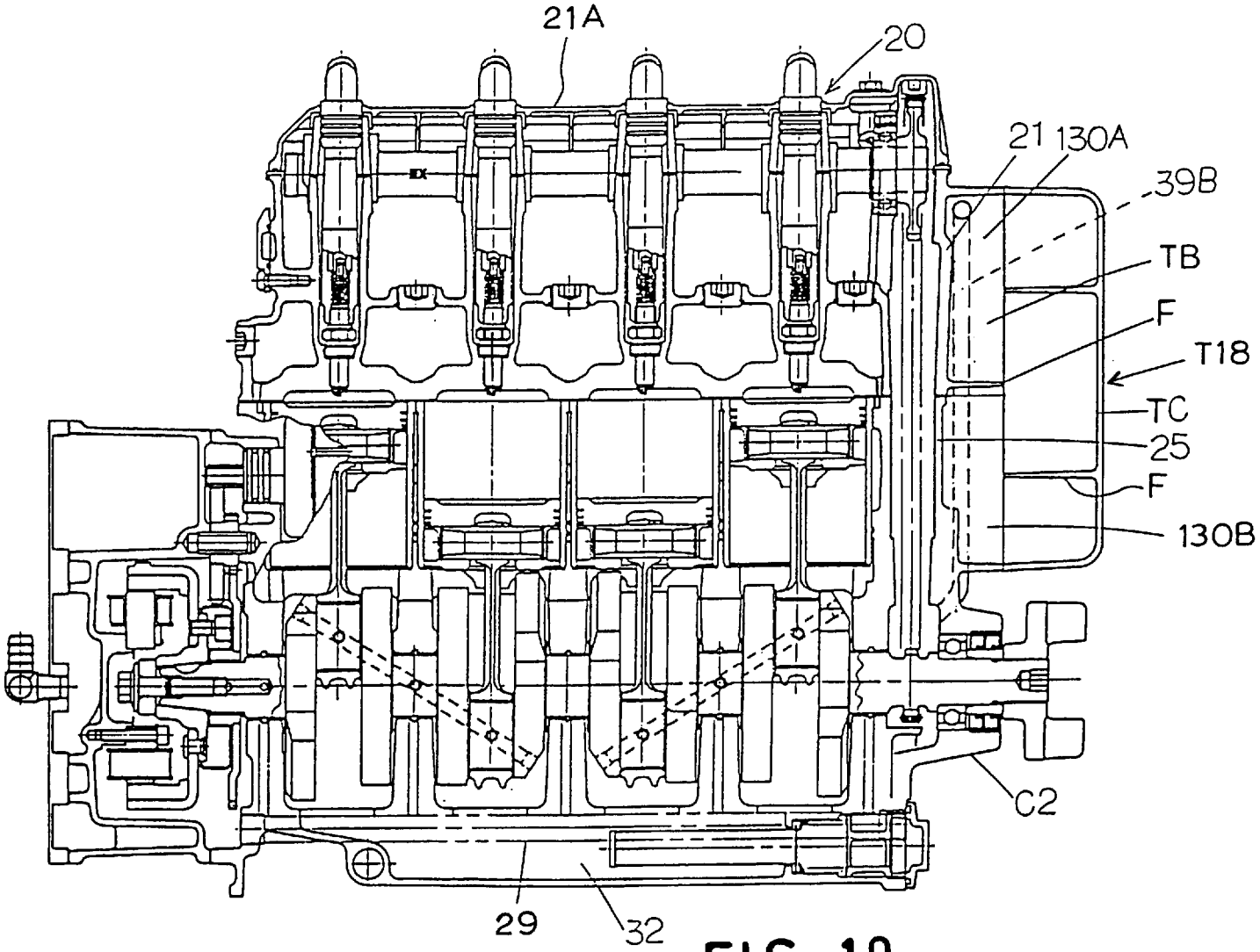

In an engine 20 shown in FIG. 19 according to an eighteenth embodiment, an oil tank T18 is arranged above a coupling case C2 on the rear of the engine. The tank base portion TB includes an upper base portion 130A integrally formed with the front portion of the cylinder head 21 and a lower base portion 130B integrally formed with the front portion of the cylinder block 25. After these two portions are closely joined with each other, the tank cover TC is closely mounted from outside thereby to form the oil tank T18. A plurality of oil mist separation fins F are formed in staggered opposed relation to each other in the tank base portion TB and the tank cover TC. The breather pipe 39B is communicated between the upper portion of the oil tank T18 and the coupling case C2, and the blow-by gas is introduced into the suction device through the coupling case C2. The oil tank T18, like the oil tank T10 according to the tenth embodiment, is intended to increase the capacity taking the advantage of space above the coupling case C2.

Figure 20:
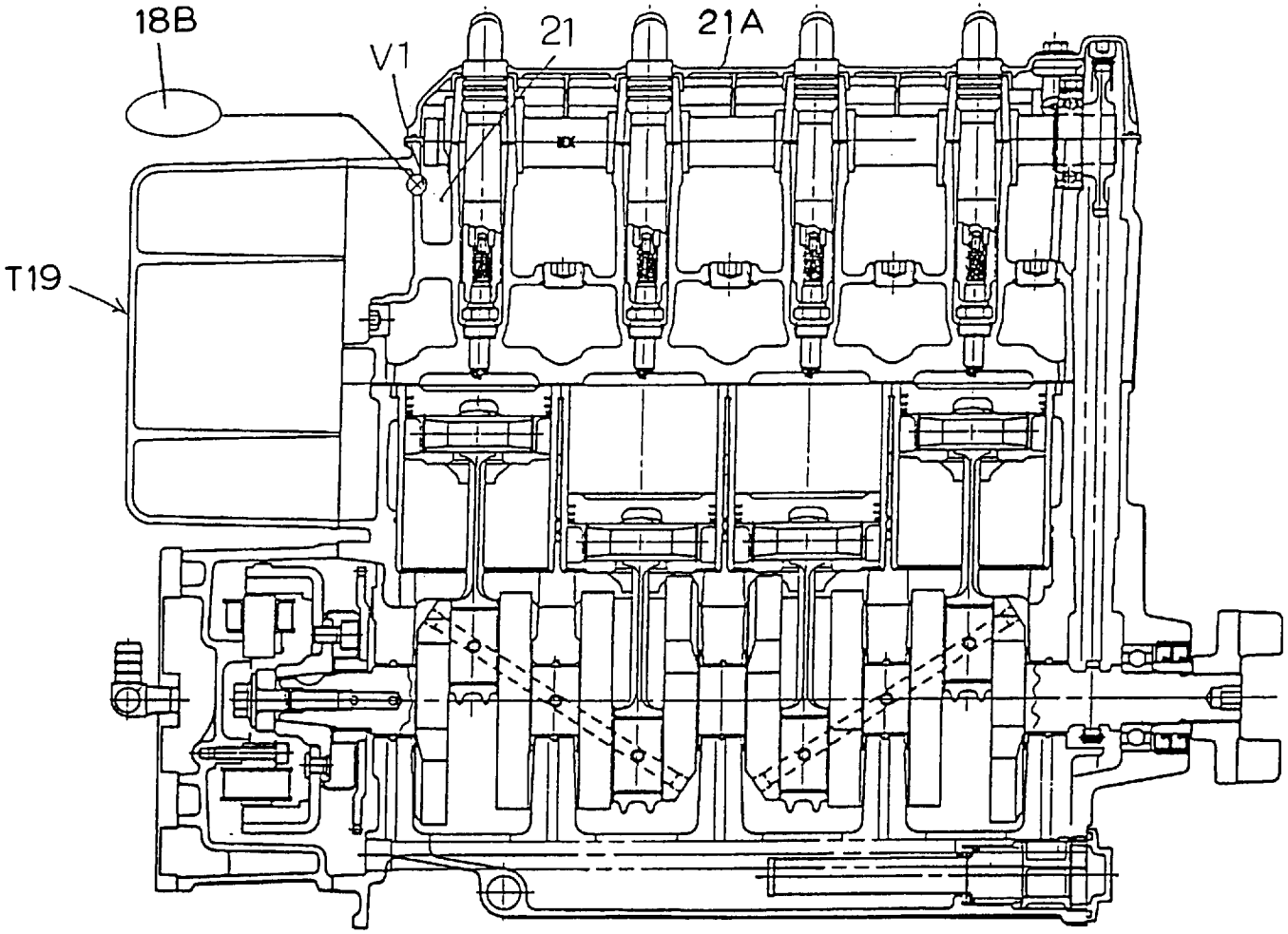
Figure 21:
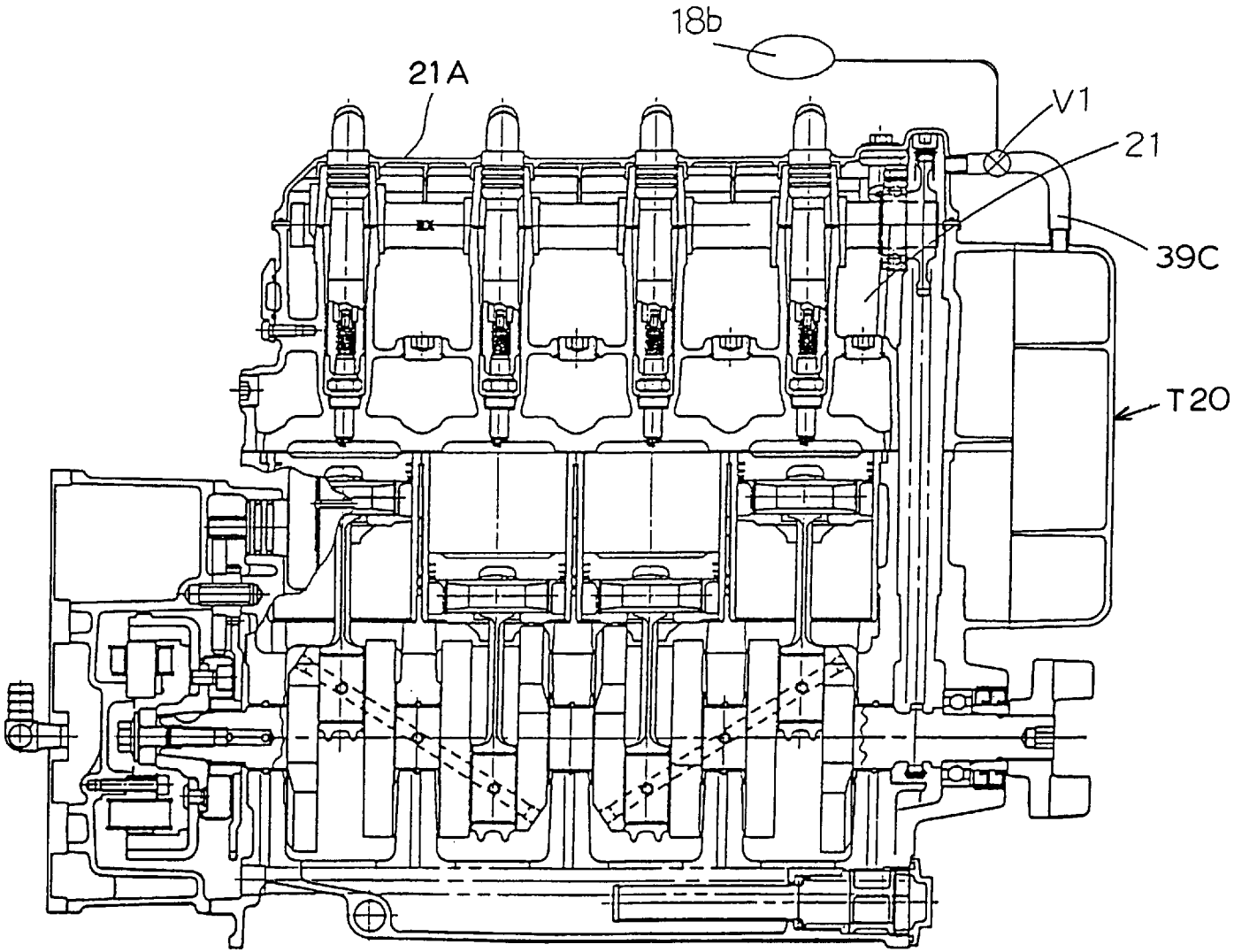

In an oil tank T19 shown in FIG. 20 according to a nineteenth embodiment and an oil tank T20 shown in FIG. 21 according to a twentieth embodiment, are similar to the oil tank T17 according to the seventeenth embodiment and the oil tank T18 according to the eighteenth embodiment, respectively. In the oil tank T19 or the oil tank T20, however, the breather passage communicating between a cylinder head 21 and the oil tank T19, or cylinder head cover 21A and the oil tank T20, includes a solenoid valve V1 connected with the turn-over detection switch 18*b* described above. Also, the oil tank T19 lacks the breather pipe, and the oil tank T20 has the breather pipe 39B from the upper surface of the oil tank T20 coupled directly to the cylinder head cover 21A.

The internal combustion engines according to the thirteenth to twentieth embodiments described above are similar to the first to twelfth embodiments in that the oil tank and the engine body are integrally formed with each other. In view of the fact that the tank base portion TB and the tank cover TC are fabricated separately, therefore, the oil tank can be fabricated more easily than in the first to twelfth embodiments. It is thus very easy to form the fins F in the tank.

I claim:

1. A four-cycle internal combustion engine for driving a propulsion means of a small planing watercraft, comprising:

an engine body having a longitudinal axis;

a crankcase in said engine body;

an oil receptacle located at the bottom of said engine body and communicating with the interior of said crankcase;

said oil receptacle extending in a longitudinal direction with respect to said engine body longitudinal axis for collecting oil in said crankcase;

an oil tank integrated with said engine body and formed by utilizing a wall of the engine body and separated from said oil receptacle by said wall;

a scavenging pump in said engine body communicating with said oil tank;

a feed pump in said engine body communicating with said oil tank;

a first oil passage formed in said crankcase communicating with said scavenging pump for transporting engine oil collected in the oil receptacle to said oil tank; and a second oil passage formed in said engine body communicating with said feed pump for supplying engine oil from the oil tank to various parts in the engine body.

2. An internal combustion engine for the small planing watercraft according to claim 1, wherein the oil receptacle is formed on the side of the bottom portion of said crankcase.

3. An internal combustion engine for the small planing watercraft according to claim 1, wherein said oil tank is formed on the side wall of a crankcase and on the side wall of a cylinder block as viewed in the direction of the axis of a crankshaft.

4. An internal combustion engine for the small planing watercraft according to claim 1, wherein said oil tank and said crankcase are formed with divided portions which are divided by substantially horizontal plane and joined with each other.

5. An internal combustion engine for the small planing watercraft according to claim 1, wherein said oil tank includes a tank base portion integrally formed with the wall of the engine body, and a tank cover mounted on said tank base portion.

6. An internal combustion engine for the small planing watercraft according to claim 5, wherein said tank base portion is formed on the side wall of the crankcase and on the side wall of the cylinder block as viewed in the direction of the axis of the crankshaft.

7. An internal combustion engine for the small planing watercraft according to claim 5, wherein said tank base portion and said crankcase are formed with divided portions which are divided by horizontal plane and joined with each other.

8. An internal combustion engine for the small planing watercraft according to claim 1, wherein said oil tank is formed on a side wall of the cylinder head and on a side wall of a cylinder block at a longitudinal end side of the crankshaft.

9. An internal combustion engine for the small planing watercraft according to claim 1, wherein said oil tank includes oil mist separating fin arranged on the inner surface thereof.

10. An internal combustion engine for the small planing watercraft according to claim 1, wherein the upper part of said oil tank is communicated with the air suction device of the engine by a breather passage by way of the height in the neighborhood of the bottom of said oil tank.

11. A four-cycle internal combustion engine for driving a propulsion means of a small planing watercraft, comprising:

an engine body;

a crankcase in said engine body;

an oil receptacle located at the bottom of said engine body and communicating with the interior of said crankcase;

an oil tank formed by utilizing a wall of the engine body;

a first oil passage including a scavenging pump for transporting engine oil collected in the oil receptacle to said oil tank;

a second oil passage including a feed pump for supplying engine oil from the oil tank to various parts in the engine body; and a valve arranged in a breather passage communicating between the upper part of said oil tank and the suction device of the engine to close the breather passage when the small planing watercraft turns over.

12. A four-cycle internal combustion engine for driving a propulsion means of a small planing watercraft, comprising:

an engine body;

a crankcase in said engine body;

an oil receptacle located at the bottom of said engine body and communicating with the interior of said crankcase;

an oil tank formed by utilizing a wall of the engine body;

a first oil passage including a scavenging pump for transporting engine oil collected in the oil receptacle to said oil tank;

a second oil passage including a feed pump for supplying engine oil from the oil tank to various parts in the engine body; and a turn-over detection switch disposed for automatically stopping the engine when the small planing watercraft turns over.

* * * * *

UNITED STATES PATENT AND TRADEMARK OFFICE

CERTIFICATE OF CORRECTION

PATENT NO. : 5,887,564

DATED : March 30, 1999

INVENTOR(S) : Yuichi Kawamoto

It is certified that error appears in the above-identified patent and that said Letters Patent is hereby corrected as shown below:

Title page, item [21] Application No. should read --866,687--

Signed and Sealed this

Fifth Day of December, 2000

*Attest:*

*Attesting Officer*

Q. TODD DICKINSON

*Director of Patents and Trademarks*